US011390436B2

(12) United States Patent
Arand

(10) Patent No.: US 11,390,436 B2
(45) Date of Patent: Jul. 19, 2022

(54) TAMPERPROOF BEVERAGE CONTAINER WITH ROTATABLE LID, AND METHOD OF ASSEMBLING AND UNSEALING SAME

(71) Applicant: Joseph F. Arand, Chicago, IL (US)

(72) Inventor: Joseph F. Arand, Chicago, IL (US)

( * ) Notice: Subject to any disclaimer, the term of this patent is extended or adjusted under 35 U.S.C. 154(b) by 107 days.

(21) Appl. No.: 16/920,681

(22) Filed: Jul. 4, 2020

(65) Prior Publication Data

US 2021/0016942 A1 Jan. 21, 2021

Related U.S. Application Data

(60) Provisional application No. 62/874,813, filed on Jul. 16, 2019.

(51) Int. Cl.

| | |
|---|---|
| ***B65D 51/22*** | (2006.01) |
| ***B65D 43/02*** | (2006.01) |
| ***B65D 85/72*** | (2006.01) |
| ***B65D 47/06*** | (2006.01) |

(52) U.S. Cl.

CPC ..... *B65D 51/226* (2013.01); *B65D 43/0231* (2013.01); *B65D 47/06* (2013.01); *B65D 85/72* (2013.01); *B65D 2251/009* (2013.01); *B65D 2251/0018* (2013.01); *B65D 2251/0093* (2013.01); *B65D 2251/20* (2013.01); *B65D 2401/15* (2020.05); *B65D 2577/2058* (2013.01)

(58) Field of Classification Search

CPC .... B65D 43/18; B65D 47/106; B65D 51/222; B65D 51/224

See application file for complete search history.

(56) References Cited

U.S. PATENT DOCUMENTS

| | | | | |
|---|---|---|---|---|
| 2,066,390 A * | 1/1937 | Cahoon | B65D 47/36 | 215/253 |
| 4,747,499 A * | 5/1988 | Gach | B65D 51/145 | 215/250 |
| 2010/0206875 A1 * | 8/2010 | Bratsch | B65D 47/265 | 220/259.1 |

* cited by examiner

*Primary Examiner* — Andrew T Kirsch

(57) ABSTRACT

A tamperproof beverage container unsealed by rotation of a lid is disclosed herein. In a general example embodiment, the beverage container includes a body configured to seal a beverage therein, the body including at least a top surface, the top surface including a main surface and at least one sealing surface covering at least one body aperture, and a lid configured to at least partially cover the top surface of the body, the lid including at least one projection which unseals the at least one sealing surface to reveal the at least one body aperture when the lid is rotated with respect to the body.

20 Claims, 18 Drawing Sheets

TAMPERPROOF BEVERAGE CONTAINER WITH ROTATABLE LID, AND METHOD OF ASSEMBLING AND UNSEALING SAME

PRIORITY

This patent application claims priority to U.S. Provisional Patent Application No. 62/874,813, filed Jul. 16, 2019, entitled "Tamperproof Beverage Container with Rotatable Lid, and Method of Assembling and Unsealing Same," the entirety of which is incorporated herein by reference and relied upon.

FIELD OF THE DISCLOSURE

The present disclosure relates generally to a tamperproof beverage container with a rotatable lid, and more specifically to a beverage container which utilizes the rotation of the lid to open a tamperproof seal, for example, to enhance the freshness of a beverage such as refrigerated coffee.

BACKGROUND

Various beverage containers for storing beverages are available on the market. Two of the most common styles of beverage containers are: (1) a bottleneck container, which opens with a twist-off cap; and (2) an aluminum can, which opens with a pull tab. Certain beverages that may be contained in such beverage containers, however, either taste differently through the typical bottleneck or aluminum opening based on the geometry of the opening, or taste differently because the ingredients are negatively affected by the metallic taste of the aluminum or other material around the opening.

SUMMARY

The present disclosure provides an improved beverage container, which allows a beverage to be stored in a sealed manner, and which may be quickly unsealed and consumed by rotating the lid. In a general example embodiment, a beverage container includes a body configured to seal a beverage therein, the body including at least a top surface, the top surface including a main surface and at least one sealing surface covering a body aperture, and a lid configured to at least partially cover the top surface of the body, the lid including at least one projection which unseals the at least one sealing surface to reveal the body aperture when the lid is rotated with respect to the body.

In a general example embodiment, a beverage container includes a body configured to seal a beverage therein, the body including a top surface, the top surface including a main surface, a first sealing surface covering a first body aperture, and a second sealing surface covering a second body aperture, and a lid configured to at least partially cover the top surface of the body, the lid including (i) a first projection which unseals the first sealing surface to reveal the first body aperture when the lid is rotated with respect to the body, and (ii) a second projection which unseals the second sealing surface to reveal the second body aperture when the lid is rotated with respect to the body.

In a general example embodiment, a beverage container includes a body configured to seal a beverage therein, the body including a top surface, the top surface including a main surface and at least one sealing surface covering a body aperture, and a lid configured to at least partially cover the top surface of the body, the lid including at least one projection and at least one lid aperture, wherein rotation of the lid with respect to the body is configured to cause: (i) the at least one projection to unseal the sealing surface to reveal the body aperture; and (ii) the at least one lid aperture to align with the at least one body aperture so that the beverage may be poured from the body through the at least one body aperture and the at least one lid aperture.

In a general example embodiment, a beverage container includes a body configured to seal a beverage therein, the body including a top surface, the top surface including a main surface, a first sealing surface covering a first body aperture, and a second sealing surface covering a second body aperture, and a lid configured to at least partially cover the top surface of the body, the lid including: (i) a first lid aperture configured to align with the first body aperture when the lid is rotated with respect to the body to unseal the first sealing surface from the first body aperture; and (ii) a second lid aperture configured to align with the second body aperture when the lid is rotated with respect to the body to unseal the second sealing surface from the second body aperture.

In a general example embodiment, a beverage container includes a body configured to seal a beverage therein, the body including a top surface, at least one side surface, and a bottom surface, the top surface including a main surface and at least one sealing surface covering a body aperture, wherein the at least one sealing surface may be unsealed to reveal the body aperture by applying a force to the at least one sealing surface, the force applied in a rotational direction around a center point of the top surface of the body.

In a general example embodiment, a lid for a beverage container includes a top surface including at least one aperture, a protrusion configured to attach the top surface to a body containing a sealed beverage, and a projection configured to unseal the beverage as the top surface is rotated with respect to the body while the protrusion attaches the lid to the body, such that a user may thereafter pour the beverage through the at least one aperture of the top surface.

In a general example embodiment, a method of sealing a beverage container for a user to thereafter unseal to consume a beverage provided therein includes sealing a beverage into a body having a top surface including at least one sealing surface, attaching a lid including a projection to the top surface of the body, and enabling the lid to be rotated with respect to the body to cause the projection to unseal the at least one sealing surface so that the beverage may be dispensed through the lid.

In a general example embodiment, a method of unsealing a beverage container includes rotating a lid with respect to a body containing a sealed beverage so that a projection of the lid unseals at least one sealing surface of the body so that the beverage may be dispensed through the lid.

In a general example embodiment, a liquid container includes a body configured to seal a liquid therein, the body including at least a top surface, the top surface including a main surface and at least one sealing surface covering a body aperture, and a lid configured to at least partially cover the top surface of the body, the lid including at least one projection which unseals the at least one sealing surface to reveal the body aperture when the lid is translated towards the body and/or rotated with respect to the body.

In a general example embodiment, a liquid container includes a body configured to seal a liquid therein, the body including a top surface, the top surface including a main surface and at least one sealing surface covering a body aperture, and a lid configured to at least partially cover the top surface of the body, the lid including at least one projection and at least one lid aperture, wherein rotation of the lid with respect to the body is configured to cause: (i) the at least one projection to unseal the sealing surface to reveal the body aperture; and (ii) the at least one lid aperture to align with the at least one body aperture so that the liquid may be poured from the body through the at least one body aperture and the at least one lid aperture.

In a general example embodiment, a lid for a beverage container includes a top surface including at least one aperture, a protrusion configured to attach the top surface to a body containing a sealed beverage, and a projection configured to unseal the beverage as the top surface is translated towards the body while the protrusion attaches the lid to the body, such that a user may thereafter pour the beverage through the at least one aperture of the top surface.

In a general example embodiment, a method of sealing a beverage container for a user to thereafter unseal to consume a beverage provided therein includes sealing a beverage into a body having a top surface including at least one sealing surface, attaching a lid including a projection to the top surface of the body, and enabling the lid to be translated towards the body to cause the projection to unseal the at least one sealing surface so that the beverage may be dispensed through the lid.

In a general example embodiment, a beverage container includes a body configured to seal a beverage therein, the body including at least a top surface, the top surface including a main surface and at least one sealing surface covering a body aperture, and a lid configured to at least partially cover the top surface of the body, the lid including at least one projection which unseals the at least one sealing surface to reveal the body aperture when the lid is translated towards the body.

BRIEF DESCRIPTION OF THE FIGURES

Embodiments of the present disclosure will now be explained in further detail by way of example only with reference to the accompanying figures, in which.

DETAILED DESCRIPTION

Before the disclosure is described, it is to be understood that this disclosure is not limited to the particular apparatuses and methods described. It is also to be understood that the terminology used herein is for the purpose of describing particular embodiments only, and is not intended to be limiting, since the scope of the present disclosure will be limited only to the appended claims.

As used in this disclosure and the appended claims, the singular forms "a," "an" and "the" include plural referents unless the context clearly dictates otherwise. The methods and apparatuses disclosed herein may lack any element that is not specifically disclosed herein.

Figure 1A:
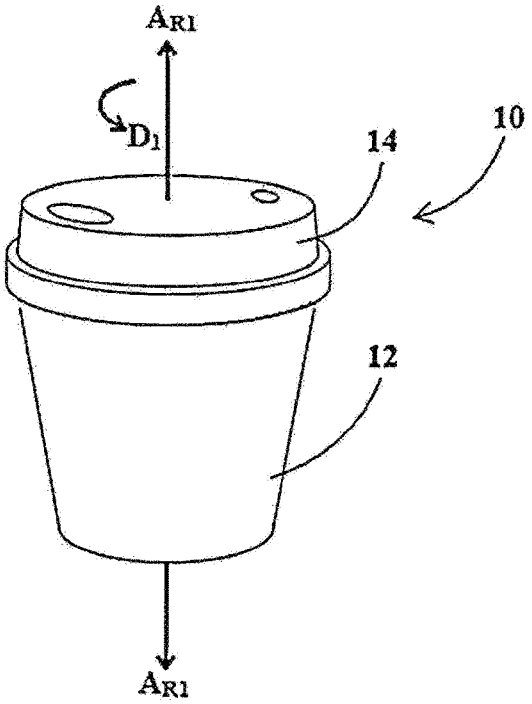
FIG. 1A illustrates a front perspective view of an example embodiment of a beverage container according to the present disclosure, wherein the beverage container is in a sealed configuration.
Figure 1B:
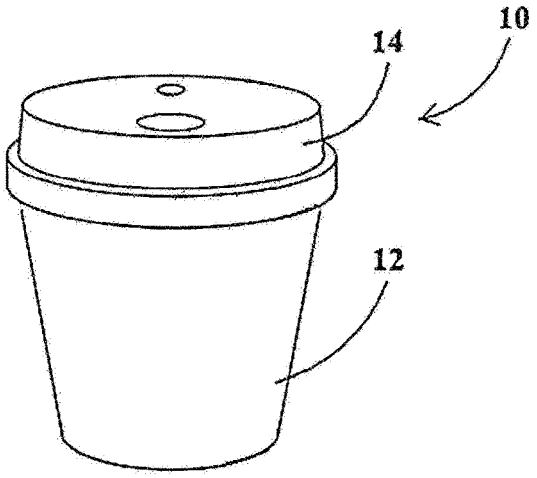
FIG. 1B illustrates a front perspective view of the beverage container of FIG. 1A, wherein the beverage container is in an unsealed configuration.
Figure 2A:
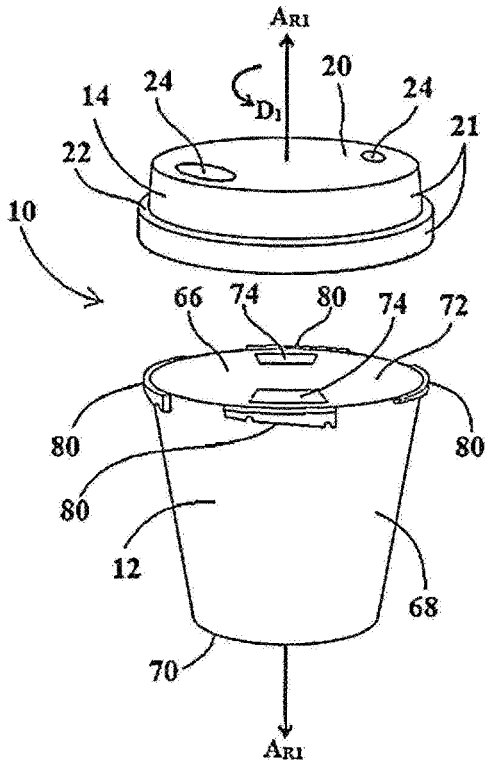
FIG. 2A illustrates an exploded perspective view of the beverage container of FIG. 1A in the sealed configuration.
Figure 2B:
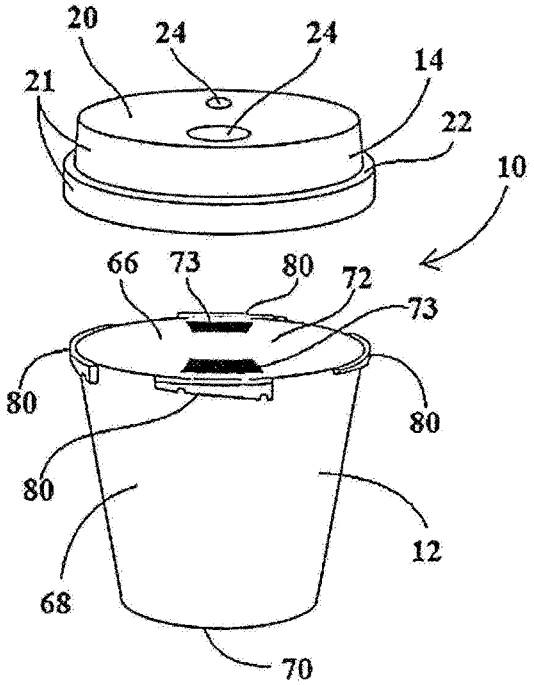
FIG. 2B illustrates an exploded perspective view of the beverage container of FIG. 1B in the unsealed configuration.
Figure 3:
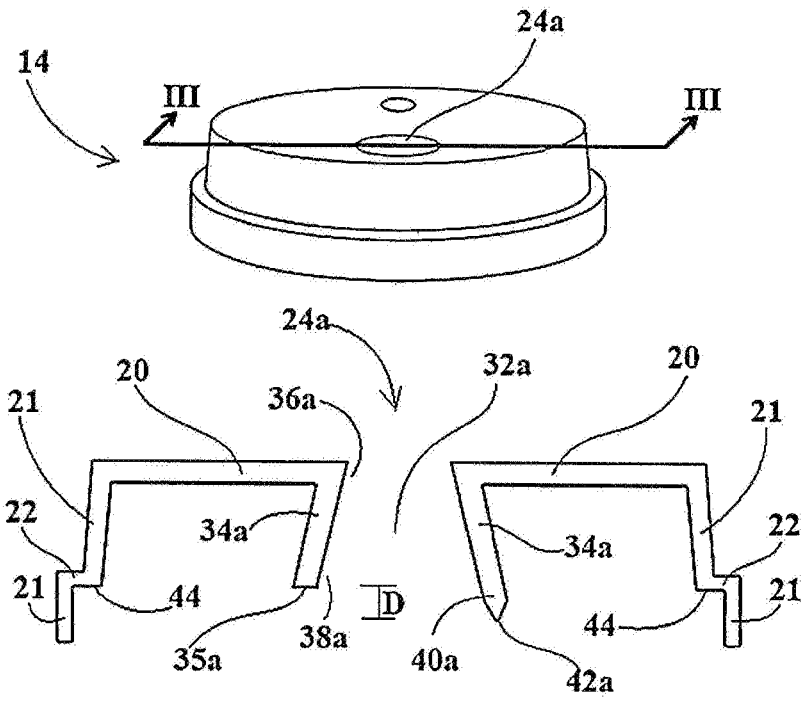
FIG. 3 illustrates a front side cross-sectional view of the lid of the beverage container of FIGS. 1A and 1B, taken through lines III-III.
Figure 4:
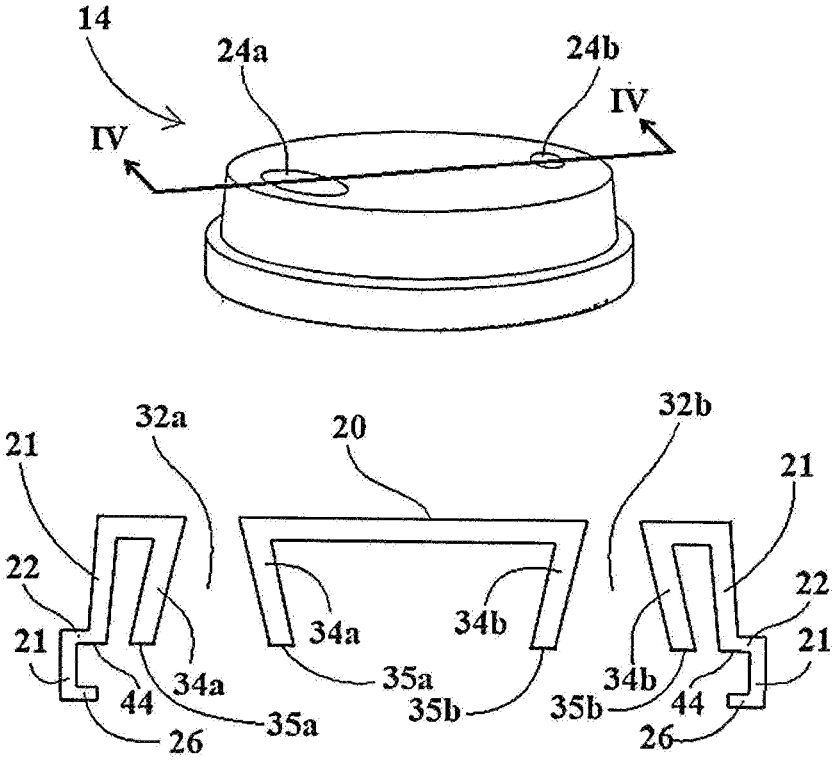
FIG. 4 illustrates a side cross-sectional view of the lid of the beverage container of FIGS. 1A and 1B, taken through lines IV-IV.
Figure 5:
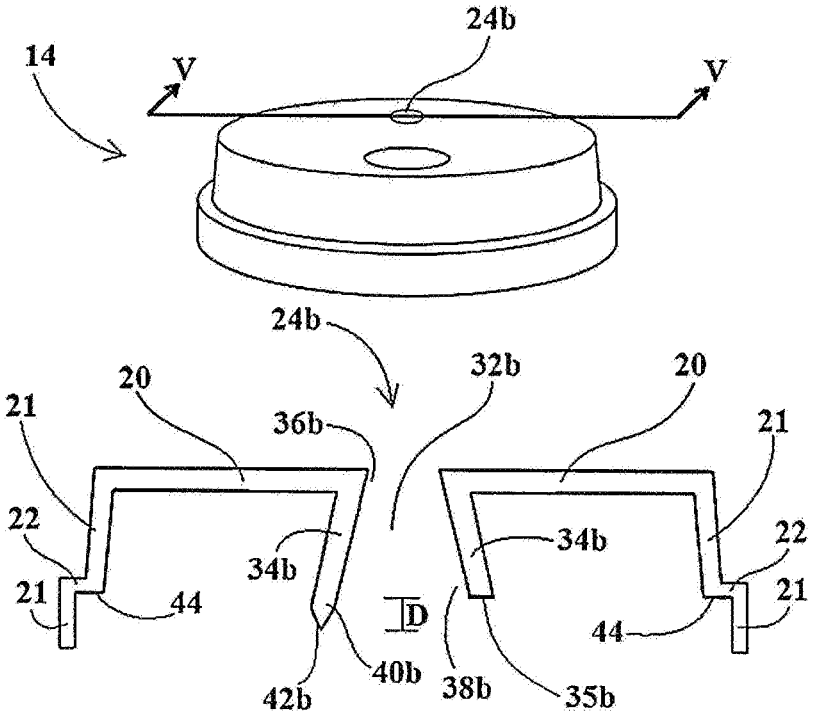
FIG. 5 illustrates a front side cross-sectional view of the lid of the beverage container of FIGS. 1A and 1B, taken through lines V-V.
Figure 6:
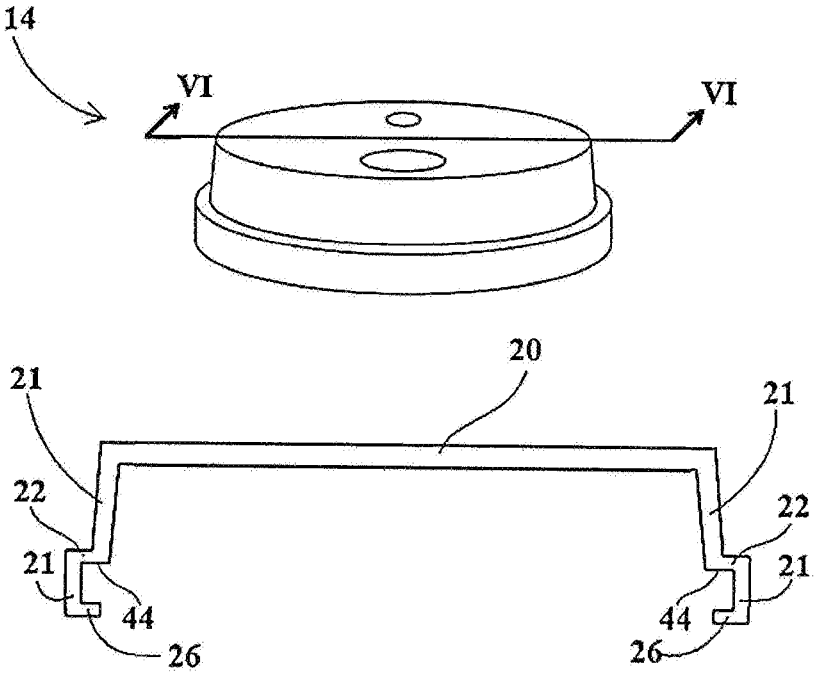
FIG. 6 illustrates a front side cross-sectional view of the lid of the beverage container of FIGS. 1A and 1B, taken through lines VI-VI.

FIGS. 1 and 2 illustrate an example embodiment of a beverage container 10 according to the present disclosure. FIGS. 1A and 2A illustrate beverage container 10 in a sealed configuration wherein a beverage is sealed from the outside environment, while FIGS. 1B and 2B illustrate beverage container 10 in an unsealed configuration wherein a user may drink the beverage therein.

In the illustrated embodiment, beverage container 10 includes a body 12 and a lid 14. Lid 14 may be removably attached to body 12 by pushing lid 14 towards body 12 and/or rotating lid 14 with respect to body 12 (e.g., rotating lid 14 with respect to body 12 in the direction $D_1$ around the rotational axis $A_{R1}$ through the center of lid 14 and/or body 12). Attachment of lid 14 to body 12 is discussed in more detail below. In the illustrated embodiment, the beverage within body 12 is sealed from the outside environment until after lid 14 is attached to body 12 and used to unseal the beverage.

FIGS. 3 to 6 illustrate an example embodiment of lid 14 in more detail. In the illustrated embodiment, lid 14 includes one or more of a top surface 20, one or more side surface 21, a lip 22, one or more aperture structure 24, and one or more protrusions 26. Lid 14 may be formed, for example, from plastic, a metal such as aluminum, another suitable material, or a combination of multiple suitable materials.

In the illustrated embodiment, the at least one aperture structure 24 includes a first aperture structure 24*a* and a second aperture structure 24*b* (shown generally as reference number 24 in some figures). First aperture structure 24*a* is configured to provide a drinking aperture for the user, while second aperture structure 24*b* is configured to enable air to pass from the outside environment into contact with the beverage within beverage container 10 so that the beverage may flow freely to the user through first aperture structure 24*a*. In an embodiment, first aperture structure 24*a* is larger than second aperture structure 24*b*, but the shapes and sizes of first aperture structure 24*a* and second aperture structure 24*b* may vary in different embodiments. In an embodiment, beverage container 10 may be formed with only first aperture structure 24*a*.

In the illustrated embodiment, first aperture structure 24*a* includes a first aperture 32*a* through top surface 20. In the illustrated embodiment, first aperture 32*a* is surrounded by at least one outer wall 34*a*. In an embodiment, the at least one outer wall 34*a* may create a conical or cylindrical structure surrounding aperture 32*a* and may extend between a first or top aperture portion 36*a* of first aperture 32*a* and a second or bottom aperture portion 38*a* of aperture 32*a*. In the illustrated embodiment, second portion 38*a* is larger than first aperture portion 36*a* to create a conical structure, but those of ordinary skill in the art will recognize from this disclosure that different shapes and sizes for first aperture portion 36*a* and second aperture portion 38*a* are suitable for use with the beverage containers disclosed herein. In the illustrated embodiment, first aperture portion 36*a* is located near a user's lips when the user is drinking the beverage from beverage container 10, while second aperture portion 38*a* is placed near body 12 to receive the beverage and enable the beverage to flow through aperture 32*a* to the user. An advantage of the present disclosure is that different types of lids 14 with different types of aperture structures 24 for different types of beverages may be easily interchanged with different types of bodies 12.

In the illustrated embodiment, at least a portion of the at least one outer wall 34*a* includes a projection 40*a* which extends a distance D below a bottom surface 35*a* of outer wall 34*a*. Projection 40*a* may further include a piercing tip 42*a* configured to pierce a sealing surface 74*a* to unseal the beverage within beverage container 10. In an embodiment, projection 40*a* may further be angled outwardly or inwardly to facilitate piercing of sealing surface 74*a* when lid 14 is rotated with respect to body 12. In an embodiment, projection 40*a* may protrude from top surface 20 and/or side surface 21 instead of from outer wall 34*a*.

In the illustrated embodiment, second aperture structure 24*b* includes a second aperture 32*b* through top surface 20. In the illustrated embodiment, second aperture 32*b* is surrounded by at least one outer wall 34*b*. In an embodiment, the at least one outer wall 34*b* may create a conical or cylindrical structure surrounding second aperture 32*b* and may extend between a first or top aperture portion 36*b* of second aperture 32*b* and a second or bottom aperture portion 38*b* of aperture 32*b*. In the illustrated embodiment, second aperture portion 38*b* is larger than first aperture portion 36*b* to create a conical structure, but those of ordinary skill in the art will recognize from this disclosure that different shapes and sizes for first aperture portion 36*b* and second aperture portion 38*b* are suitable for use with the beverage containers disclosed herein.

In the illustrated embodiment, at least a portion of the at least one outer wall 34*b* includes a projection 40*b* which extends a distance D below a bottom surface 35*b* of outer wall 34*b*. Projection 40*b* may further include a piercing tip 42*b* configured to pierce a sealing surface 74*b* to unseal the beverage within beverage container 10. In an embodiment, projection 40*b* may further be angled outwardly or inwardly to facilitate piercing of sealing surface 74*b* when lid 14 is rotated with respect to body 12. In an embodiment, projection 40*b* may protrude from top surface 20 and/or side surface 21 instead of from outer wall 34*b*.

In the illustrated embodiment, lip 22 includes a bottom surface 44 which may be pressed against an outer rim 62 of body 12 when beverage container 10 is unsealed and/or when lid 14 is attached to body 12. In the illustrated embodiment, lip 22 is shown as a straight horizontal surface, but lip 22 and/or bottom surface 44 may also be angled to improve the contact between bottom surface 44 and outer rim 62 of body 12 when beverage container 10 is unsealed and/or when lid 14 is attached to body 12.

One or more protrusion 26 may extend inwardly from outer wall 21 of lid 14. In the illustrated embodiment, the protrusions 26 are inwardly facing round or cylindrical protuberances which extend into and interact with a corresponding outer tab 80 of body 12, as explained in more detail below. Other suitable shapes besides a round or cylindrical protuberance may also be used. In the illustrated embodiment, lid 14 includes four protrusions 26, equidistantly spaced 90° apart on the inner perimeter of lid 14, but those of ordinary skill in the art will recognize from this disclosure that more or less protrusions 26 may be used, and that the spacing between protrusions 26 may be altered besides as shown in the illustrated example. In use, the one or more protrusions 26 protrude to contact a track of a corresponding outer tab 80 of body 12 and enable at least one of: (i) lid 14 to be attached to body 12; and/or (ii) body 12 to be unsealed.

In the illustrated embodiment, body 12 includes a top surface 66, at least one side surface 68, and a bottom surface 70, which surfaces may seal a beverage within body 12 in an airtight manner. Body 12 may be formed, for example, from plastic, a metal such as aluminum, or another suitable material. Body 12 may further be formed in other shapes and sizes besides as shown in the illustrated embodiment, with additional surfaces added.

Figure 7:
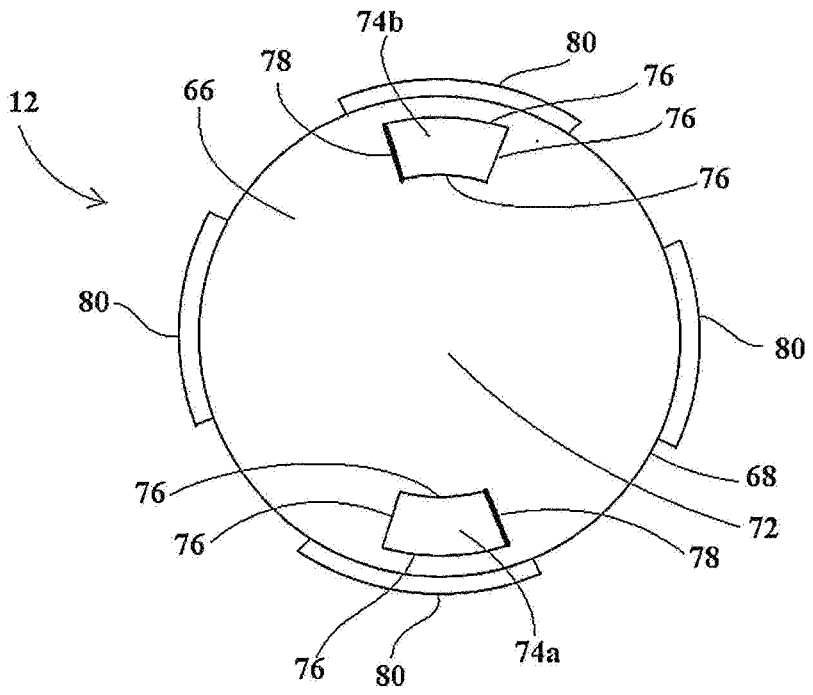
FIG. 7 illustrates a top plan view of the body of the beverage container of FIGS. 1A and 1B.

FIG. 7 illustrates the top surface 66 of body 12. In the illustrated embodiment, top surface 66 includes a main surface 72 and at least one sealing surface 74 which covers at least one body aperture 73. The at least one sealing surface 74 may be made of the same material as main surface 72, or may be made of a different material than main surface 72. In an embodiment, at least one sealing surface 74 may include a breakaway plastic seal, for example, a plastic membrane material, or may include an aluminum material. In an embodiment, the at least one sealing surface 74 is integrally formed with the main surface 72.

In the illustrated embodiment, the at least one sealing surface 74 is attached to main surface 72 by at least one break line 76, wherein the at least one sealing surface 74 on one side of break line 76 may break away from main surface 72 on the other side of break line 76 when a force is applied to the at least one sealing surface 74 and/or main surface 72. In the illustrated embodiment, the at least one sealing surface 74 is broken from main surface 72 across the at least one break line 76 when a downward force is applied to the at least one sealing surface 74 by projection 40 (e.g. first projection 40*a* or second projection 40*b*). In an alternative embodiment, the at least one sealing surface 74 may be broken from main surface 72 across the at least one break line 76 when an upward and/or sideways force is applied to the at least one sealing surface 74 by projection 40.

In the illustrated embodiment, the at least one sealing surface 74 includes three break lines 76 and a fold line 78. Fold line 78 is configured to enable the at least one sealing surface 74 to bend and/or rotate with respect to main surface 72 while remaining attached to main surface 72. In the illustrated embodiment, the at least one sealing surface 74 breaks along the three break lines 76 and bends into body 12 along fold line 78 when a force is applied to the at least one sealing surface 74 by projection 40. In an alternative embodiment, the at least one sealing surface 74 breaks along the three break lines 76 and bends upwardly from body 12 along fold line 78 when a force is applied to the at least one sealing surface 74 by projection 40. Those of ordinary skill in the art will recognize from this disclosure that more or less break lines 76 and/or fold lines 78 may be used.

In the illustrated embodiment, the at least one sealing surface 74 includes a first sealing surface 74*a* and a second sealing surface 74*b* (shown generally as reference number 74 in some figures). First sealing surface 74*a* is configured to align with first aperture structure 24*a* when beverage container 10 is unsealed, enabling a user to drink the beverage through first aperture structure 24*a*. Second sealing surface 74*b* is configured to align with second aperture structure 24*b* when beverage container 10 is unsealed, enabling air to pass from the outside environment into contact with the beverage within beverage container 10 so that the beverage may flow freely to the user through first aperture structure 24*a*.

In the illustrated embodiment, each of first sealing surface 74*a* and second sealing surface 74*b* are formed as trapezoids with top and bottom break lines 76 which curve with different radiuses taken from the center of top surface 66. This configuration is advantageous, for example, because a projection 40 may sweep through a sealing surface 74 as lid 14 is rotated with respect to body 12. It should be understood, however, that sealing surfaces 74 may be formed with other shapes as well.

In the illustrated embodiment, body 12 includes at least one outer tab 80 projecting outwardly from at least one side surface 68 and/or from top surface 66. In the illustrated embodiment, body 12 includes four outer tabs 80 equidistantly spaced 90° apart along the outer perimeter of at least one side surface 68, but those of ordinary skill in the art will recognize from this disclosure that more or less outer tabs 80 may be used, and that the spacing between outer tabs 80 may be altered besides as shown in the illustrated example. In use, the outer tabs 80 each receive a corresponding protrusion 26 of lid 14 and enable at least one of: (i) lid 14 to be attached to body 12; and/or (ii) body 12 to be unsealed.

Figure 8:
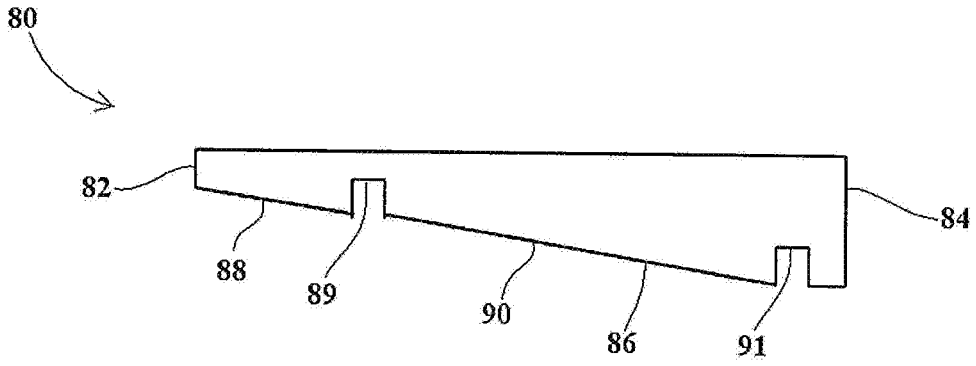
FIG. 8 illustrates a detailed view of one of the outer tabs of the body of the beverage container of FIGS. 1A and 1B.

FIG. 8 illustrates an example embodiment of an outer tab 80 in more detail. In the illustrated embodiment, outer tab 80 includes a first side surface 82, a second side surface 84, and one or more lower track surface 86 extending between first side surface 82 and second side surface 84. In the illustrated embodiment, track surface 86 includes a first angled portion 88, a first indentation 89, a second angled portion 90, and a second indentation 91. In use, a protrusion 26 translates along track surface 86 to enable at least one of: (i) lid 14 to be attached to body 12; and/or (ii) body 12 to be unsealed.

Figure 9A:
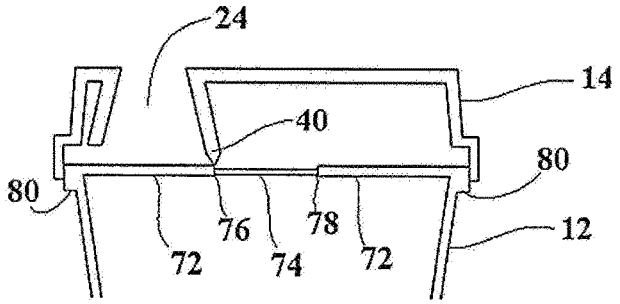
FIGS. 9A and 9B illustrate an example embodiment of a first step of assembling and/or unsealing the beverage container of FIGS. 1A and 1B, as the lid is pressed down toward the body and rotated.
Figure 9B:
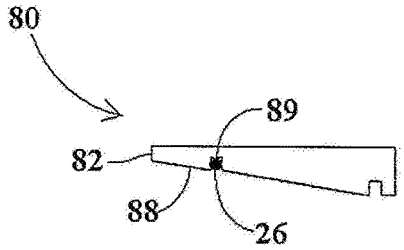
Figure 10A:
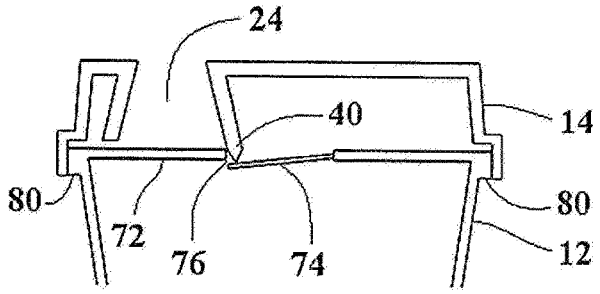
FIGS. 10A and 10B illustrate an example embodiment of a second step of assembling and/or unsealing the beverage container of FIGS. 1A and 1B, as the lid is pressed down toward the body and rotated.
Figure 10B:
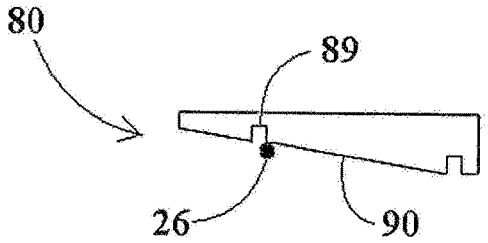
Figure 11A:
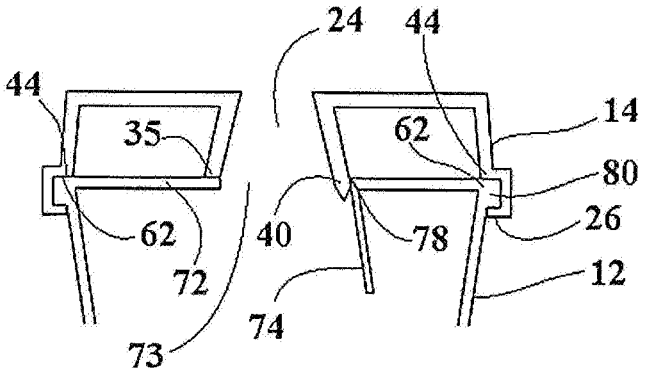
FIGS. 11A and 11B illustrate an example embodiment of a third step of assembling and/or unsealing the beverage container of FIGS. 1A and 1B, as the lid is pressed down toward the body and rotated.
Figure 11B:
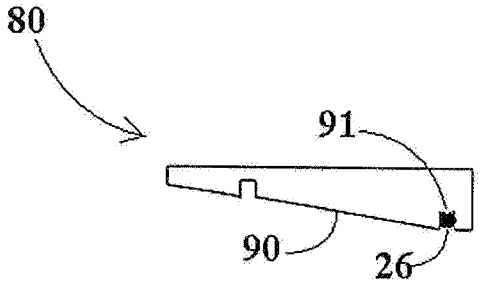

FIGS. 9A to 11B illustrate an example embodiment of how lid 14 may be attached to body 12 via rotation of lid 14 with respect to body 12, and how beverage container 10 may be unsealed by additional rotation of lid 14 with respect to body 12. In the illustrated embodiment, FIGS. 9A, 10A and 11A show the relationship between cross-sections of lid 14 and body 12 to unseal beverage container 10, while FIGS. 9B, 10B and 11B illustrate the corresponding relationship of protrusion 26 and outer tab 80 which cause the movement shown in FIGS. 9A, 10A, and 11A, respectively. Those of ordinary skill in the art will recognize from this disclosure that modifications may be made to the methods and structures shown herein without departing from the spirit and scope of the beverage containers discussed herein.

FIG. 9A illustrates beverage container 10 once lid 14 has been initially attached to body 12. At this point, beverage container 10 is still sealed. Lid 14 may be attached to body 12, for example, by (i) aligning protrusion 26 with first side surface 82 of outer tab 80, (ii) pressing lid 14 downward towards body 12 as protrusion 26 slides along first side surface 82, and (iii) rotating lid 14 with respect to body 12 such that protrusion 26 slides along first angled portion 88 of track surface 86 and into first indentation 89.

In FIGS. 9A and 9B, protrusion 26 is held within first indentation 89, for example, by the force of lid 14 pressing against body 12. In the illustrated embodiment, projection 40 (e.g. first projection 40*a* or second projection 40*b*) lies against main surface 72, and the force of projection 40 pushing against main surface 72 holds lid 14 to body 12 with beverage container 10 still sealed.

FIG. 10A illustrates beverage container 10 just as the seal is broken between the beverage therein and the outer environment. The seal may be broken, for example, (i) by pushing lid 14 towards body 12 to dislodge protrusion 26 from first indentation 89; and/or (ii) by rotating lid 14 with respect to body 12 such that protrusion 26 translates along second angled portion 90. In the illustrated embodiment, the seal breaks when projection 40 presses against the at least one sealing surface 74, causing the at least one sealing surface 74 to be broken away from main surface 72 along at least one break line 76.

FIG. 11A illustrates beverage container 10 once lid 14 has been fully rotated with respect to body 12 to completely unseal the beverage within body 12. As illustrated, as projection 40 is swept to the side (e.g., around rotational axis $A_{R1}$ in FIGS. 1A and 2A) while protrusion 26 translates along second angled portion 90, projection 40 sweeps the at least one sealing surface 74 to the side, rotating the at least one sealing surface along fold line 78, so that the at least one sealing surface 74 does not disrupt flow of the beverage through aperture 73 and/or aperture structure 24. When protrusion 26 reaches a second indentation 91, as illustrated in FIG. 11B, lid 14 and body 12 are locked into the configuration shown in FIG. 11A, wherein aperture structure 24 is aligned with a corresponding body aperture 73 in main surface 72 where the at least one sealing surface 74 used to be.

As protrusion 26 travels along second angled portion 90 between the configurations shown in FIGS. 10B and 10C, the angled nature of second angled portion 90 pulls lid 14 towards body 12, causing one or more of: (i) bottom surface 44 of lip 22 to press against outer rim 62 of body 12, thus sealing the outer perimeter of beverage container 10; and/or (ii) causing bottom surface 35 of the at least one outer wall 34 to press against main surface 72, thus sealing the outer perimeter of aperture structure 24 around body aperture 73 so that the beverage and/or air may pass therethrough.

It should be understood from this disclosure that FIGS. 9 to 11 illustrate the unsealing of first sealing surface 74*a* and/or the unsealing of second sealing surface 74*b*, which may both be opened simultaneously by the rotation of lid 14 with respect to body 12 due to the positioning and configuration of first sealing surface 74*a* and second sealing surface 74*b* on opposite sides of top surface 66 of body 12. Looking from the same side view at first sealing surface 74*a* and second sealing surface 74*b*, first sealing surface 74*a* would open in one direction, and second sealing surface 74*b* would open in the opposite direction, with both directions being the same rotational direction around the center of lid 14 and/or body 12 (e.g., around direction $D_1$ in FIGS. 1A and 2A).

In an embodiment, all or a portion of lid 14 may be made transparent, so that a user may inspect the at least one sealing surface 74 prior to opening the beverage container 10 to ensure that the at least one sealing surface 74 has not been compromised and that the beverage within beverage container 10 is safe to drink. In another embodiment, lid 14 may include one or more additional aperture to allow visual inspection of at least one sealing surface 74.

In an embodiment, body 12 and lid 14 may be formed of different materials. For example, body 12 may be formed of a metal such as aluminum which may assist in keeping the beverage therein colder for a longer period of time, while lid 14 may be formed of another material such as plastic so that the user does not have to press his or her lips up against a metal to drink the beverage. This configuration may be advantageous, for example, because certain beverages may taste differently when consumed directly from metal such as aluminum. In an alternative embodiment, body 12 and lid 14 may be formed from the same material.

Figure 12A:
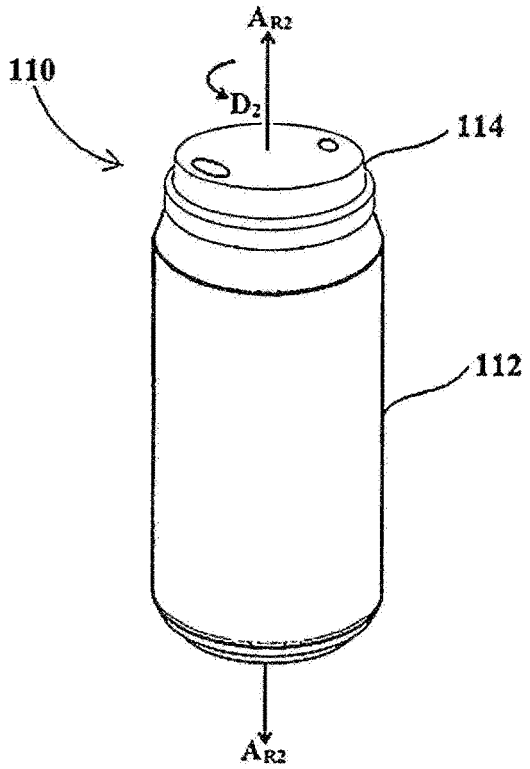
FIG. 12A illustrates a front perspective view of an example embodiment of a beverage container according to the present disclosure, wherein the beverage container is in a sealed configuration.
Figure 12B:
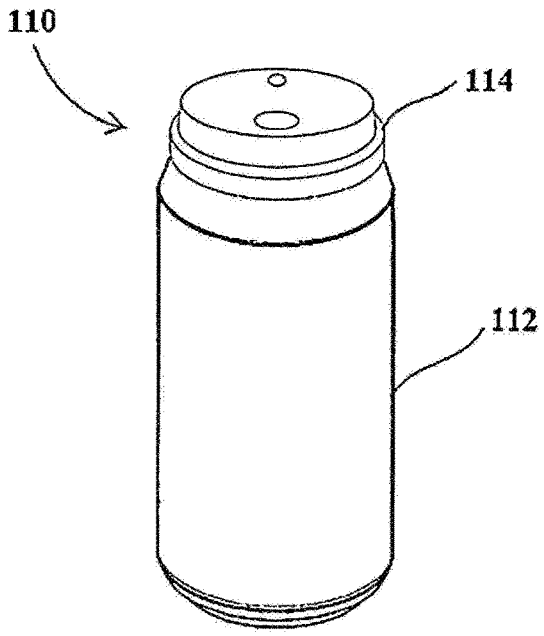
FIG. 12B illustrates a front perspective view of the beverage container of FIG. 12A, wherein the beverage container is in an unsealed configuration.
Figure 13A:
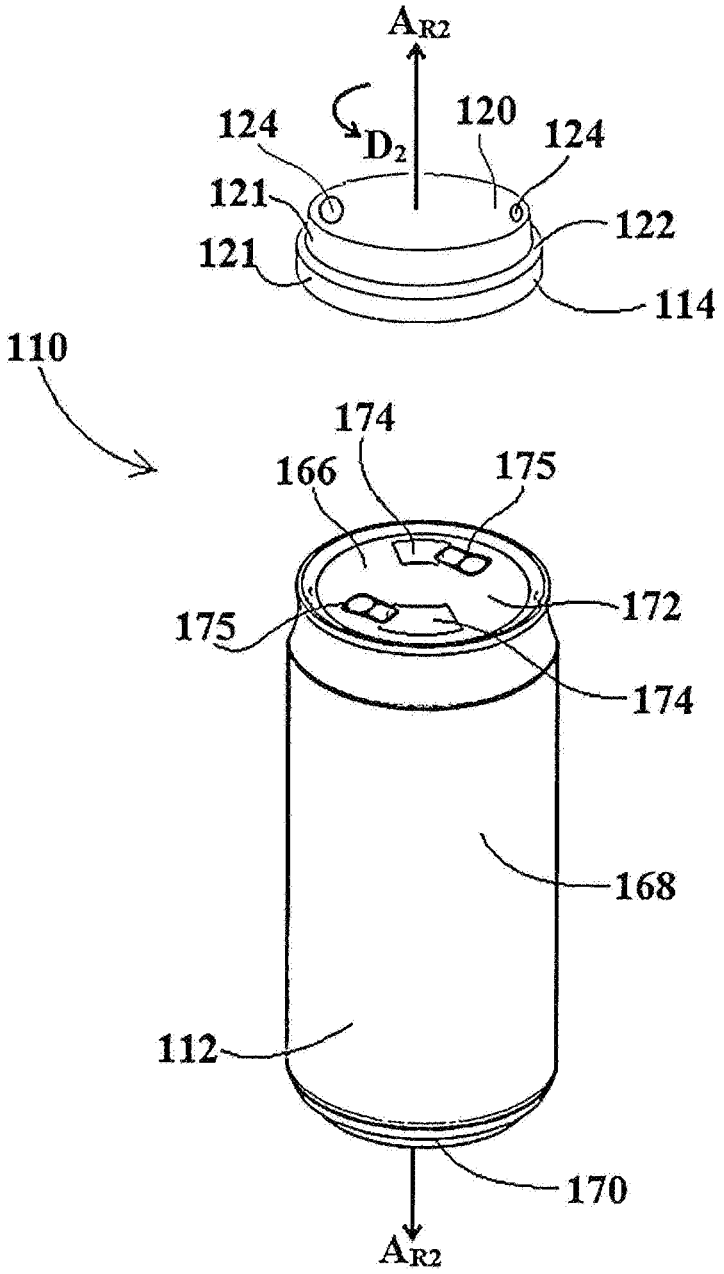
FIG. 13A illustrates an exploded perspective view of the beverage container of FIG. 12A in the sealed configuration.
Figure 13B:
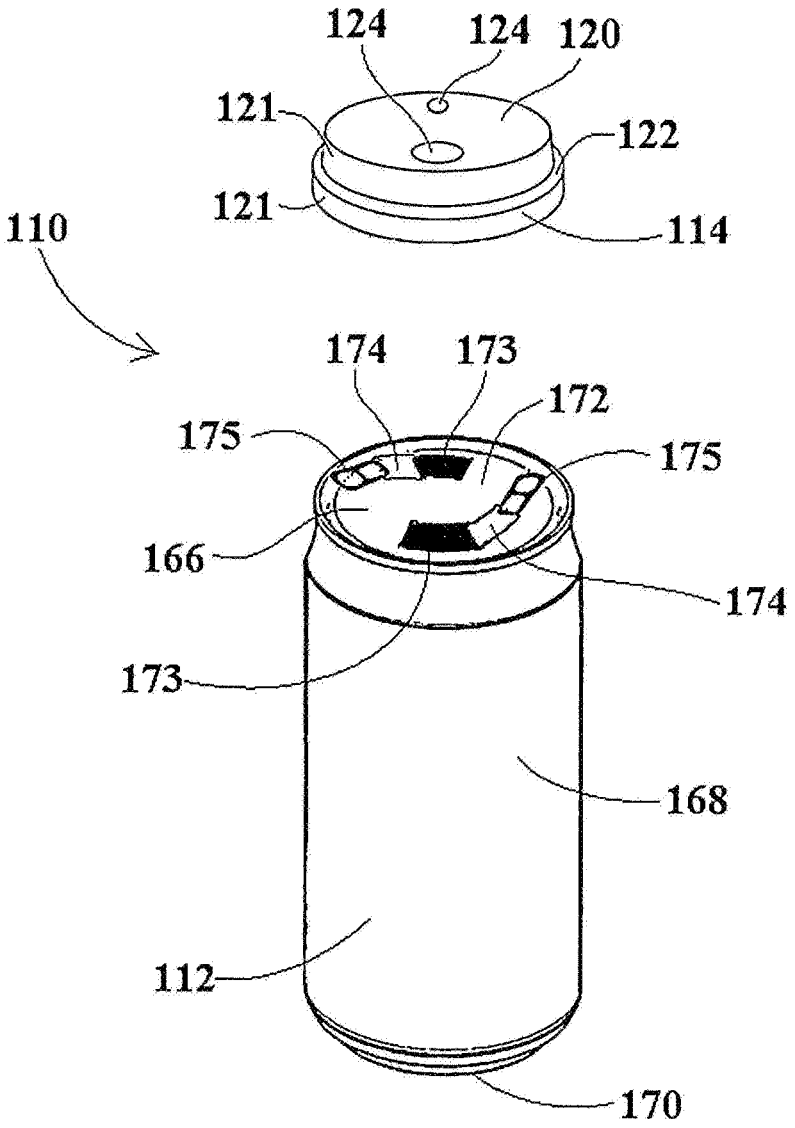
FIG. 13B illustrates an exploded perspective view of the beverage container of FIG. 12B in the unsealed configuration.

FIGS. 12 and 13 illustrate another example embodiment of a beverage container 110 according to the present disclosure. FIGS. 12A and 13A illustrate beverage container 110 in a sealed configuration wherein a beverage is sealed from the outside environment, while FIGS. 12B and 13B illustrate beverage container 110 in an unsealed configuration wherein a user may drink the beverage. It should be understood that any of the features of beverage container 10 may be combined with the features of beverage container 110, and vice versa.

In the illustrated embodiment, beverage container 110 includes a body 112 and a lid 114. Lid 114 may be removably attached to body 112 by pushing lid 114 towards body 112 and/or rotating lid 114 with respect to body 112 (e.g., rotating lid 114 with respect to body 112 in the direction $D_2$ around the rotational axis $A_{R2}$ through the center of lid 114 and/or body 112). Attachment of lid 114 to body 112 is discussed in more detail below. In the illustrated embodiment, the beverage within body 112 is sealed from the outside environment until after lid 114 is attached to body 112 and used to unseal the beverage.

Figure 14:
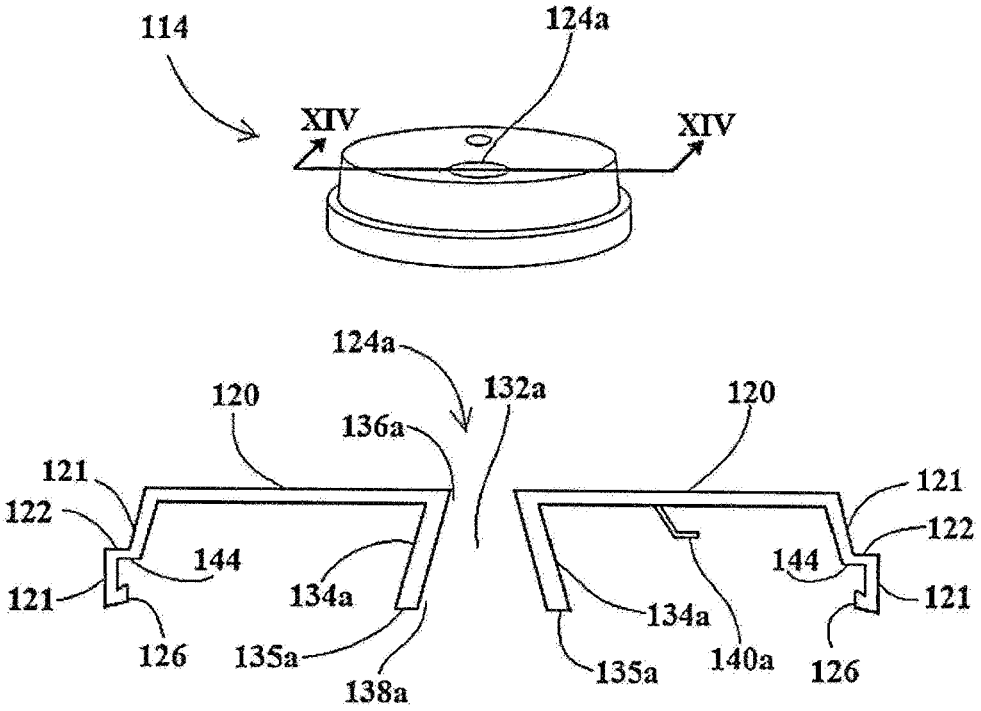
FIG. 14 illustrates a front side cross-sectional view of the lid of the beverage container of FIGS. 12A and 12B, taken through lines XIV-XIV.
Figure 15:
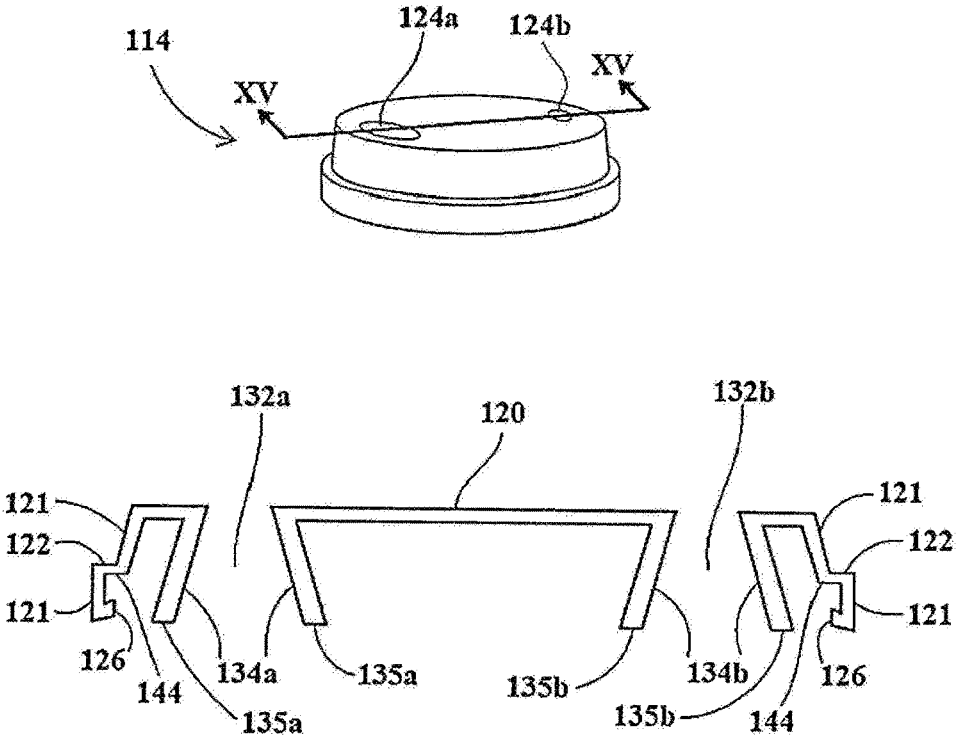
FIG. 15 illustrates a side cross-sectional view of the lid of the beverage container of FIGS. 12A and 12B, taken through lines XV-XV.
Figure 16:
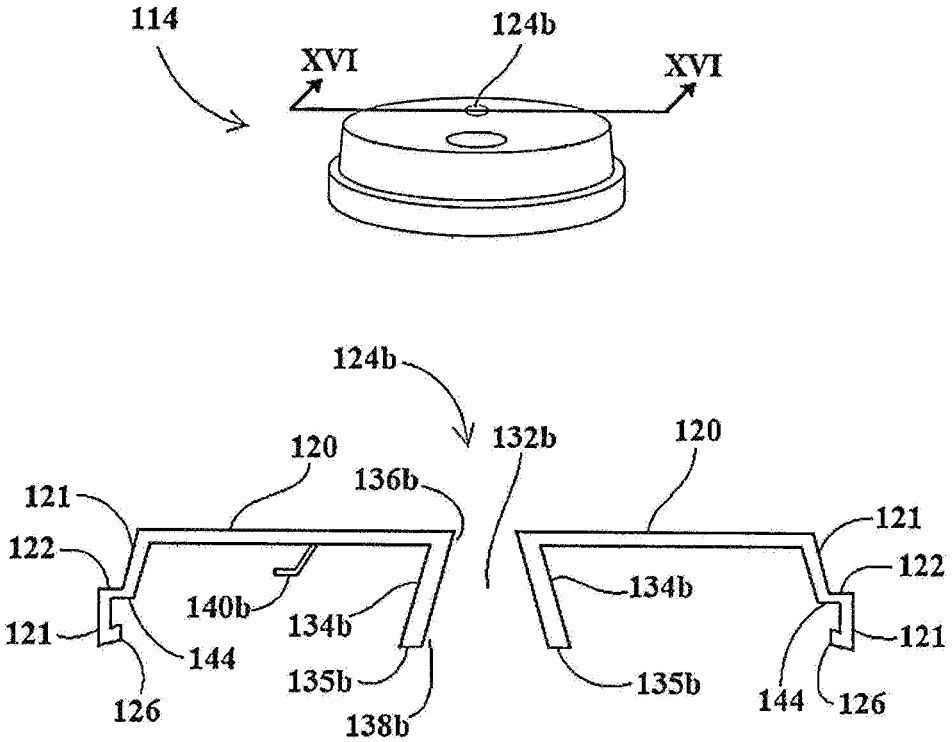
FIG. 16 illustrates a front side cross-sectional view of the lid of the beverage container of FIGS. 12A and 12B, taken through lines XVI-XVI.

FIGS. 14 to 16 illustrate an example embodiment of lid 114 in more detail. In the illustrated embodiment, lid 114 includes one or more of a top surface 120, one or more side surface 121, a lip 122, one or more aperture structure 124, one or more protrusion 126, and one or more projection 140. Lid 114 may be formed, for example, from plastic, a metal such as aluminum, another suitable material, or a combination of multiple suitable materials.

In the illustrated embodiment, the at least one aperture structure 124 includes a first aperture structure 124*a* and a second aperture structure 124*b* (shown generally as reference number 124 in some figures). First aperture structure 124*a* is configured to provide a drinking aperture for the user, while second aperture structure 124*b* is configured to enable air to pass from the outside environment into contact with the beverage within beverage container 110 so that the beverage may flow freely to the user through first aperture structure 124*a*. In an embodiment, first aperture structure 124*a* may be larger than second aperture structure 124*b*, but the shapes and sizes of first aperture structure 124*a* and second aperture structure 124*b* may vary in different embodiments. In an embodiment, beverage container 110 may be formed with only a single aperture structure 124*a*.

In the illustrated embodiment, first aperture structure 124*a* includes a first aperture 132*a* through top surface 120. In the illustrated embodiment, first aperture 132*a* is surrounded by at least one outer wall 134*a*, which extends from top surface 120 to a bottom surface 135*a*. In an embodiment, the at least one outer wall 134*a* may create a conical or cylindrical structure surrounding first aperture 132*a* and may extend between a first or top aperture portion 136*a* of first aperture 132*a* and a second or bottom aperture portion 138*a* of first aperture 132*a*. In the illustrated embodiment, second aperture portion 138*a* is larger than first aperture portion 136*a* to create a conical structure, but those of ordinary skill in the art will recognize from this disclosure that different shapes and sizes for first aperture portion 136*a* and second aperture portion 138*a* are suitable for use with the beverage containers discussed herein. In the illustrated embodiment, first aperture portion 136*a* is located near a user's lips when the user is drinking the beverage from beverage container 110, while second aperture portion 138*a* is placed near body 112 to receive the beverage and enable the beverage to flow through aperture 132*a* to the user. An advantage of the present disclosure is that different types of lids 114 with different types of aperture structures 124 for different types of beverages may be easily interchanged with different types of bodies 112.

In the illustrated embodiment, second aperture structure 124*b* includes a second aperture 132*b* through top surface 120. In the illustrated embodiment, second aperture 132*b* is surrounded by at least one outer wall 134*b*, which extends from top surface 120 to a bottom surface 135*b*. In an embodiment, the at least one outer wall 134*b* may create a conical or cylindrical structure surrounding second aperture 132*b* and may extend between a first or top aperture portion 136*b* of second aperture 132*b* and a second or bottom aperture portion 138*b* of second aperture 132*b*. In the illustrated embodiment, second aperture portion 138*b* is larger than first aperture portion 136*b* to create a conical structure, but those of ordinary skill in the art will recognize from this disclosure that different shapes and sizes for first aperture portion 136*b* and second aperture portion 138*b* are suitable for use with the beverage containers discussed herein.

In the illustrated embodiment, the one or more projection 140 includes a first projection 140*a* configured to open first sealing surface 174*a* by causing a first pull tab 175*a* to apply pressure to first sealing surface 174*a*, and includes a second projection 140*b* configured to open second sealing surface 174*b* by causing a second pull tab 175*b* to apply pressure to second sealing surface 174*b*. The method for opening the first and second sealing surfaces 174*a*, 174*b* using the first and second projections 140*a*, 140*b* occurs when lid 114 is rotated with respect to body 112 and is discussed in more detail below.

In the illustrated embodiment, lip 122 includes a bottom surface 144 which may be pressed against an outer rim 162 of body 112 when lid 114 is attached to body 112 and/or when body 112 is unsealed. In the illustrated embodiment, lip 122 is shown as a straight horizontal surface, but lip 122 may also be angled to improve the contact between bottom surface 144 and outer rim 162 of body 112 when lid 114 is attached to body 112 and/or when body 112 is unsealed.

The one or more protrusion 126 may include, for example, a ring that extends inwardly from outer wall 121 of lid 114. In the illustrated embodiment, a ring extends all the way around the inner perimeter of outer wall 121, but ring 146 may also be broken into smaller, alternating protrusions 126. In the illustrated embodiment, the one or more protrusions 126 enable lid 114 to snap-fit over outer rim 162 of body 112, which in an embodiment may be the standard outer rim of an aluminum can. In use, the one or more protrusion 126 may snap-fit lid 114 onto body 114 and enable at least one of: (i) lid 114 to be attached to body 112; and/or (ii) body 112 to be unsealed. In the illustrated embodiment, the one or more protrusion 126 enables lid 114 to be rotated with respect to body 112 once lid 114 has been attached to body 112, so that lid 114 may be used to unseal the beverage within body 112.

In the illustrated embodiment, body 112 includes a top surface 166, at least one side surface 168, and a bottom surface 170, which surfaces may seal a beverage within body 112 in an airtight manner. Body 112 may be formed, for example, from plastic, a metal such as aluminum, or another suitable material. In the illustrated embodiment, body 112 is formed as a standard aluminum can. Body 112 may further be formed in other shapes and sizes besides as shown in the illustrated embodiment, with additional surfaces added.

Figure 17:
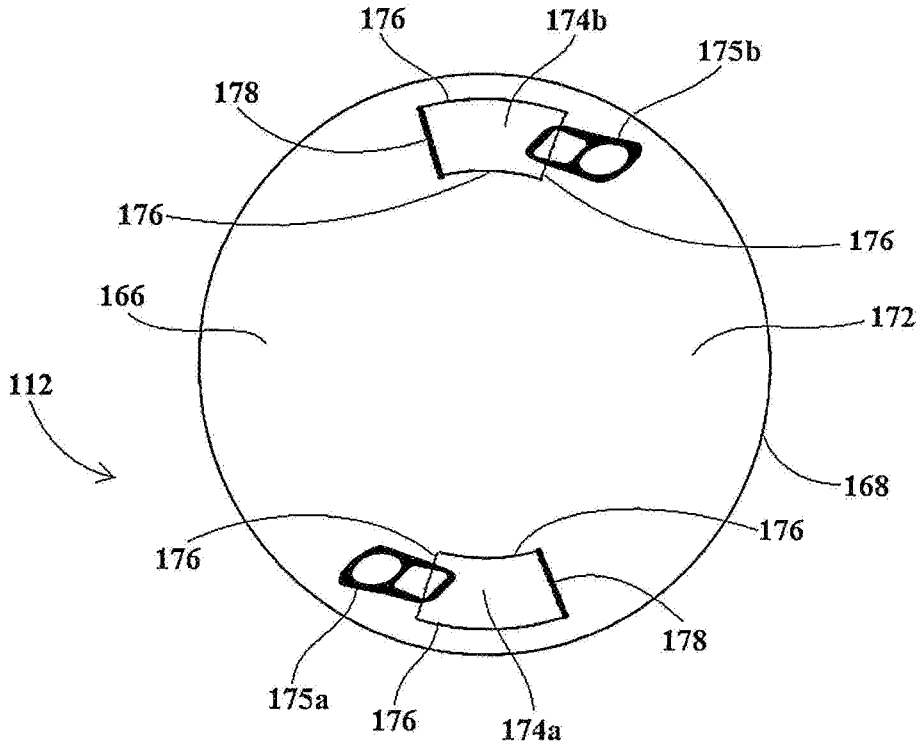
FIG. 17 illustrates a top plan view of the body of the beverage container of FIGS. 12A and 12B.

FIG. 17 illustrates the top surface 166 of body 112. In the illustrated embodiment, top surface 166 includes a main surface 172, at least one sealing surface 174 (shown as 174*a* and 174*b* in some figures) which covers a body aperture 173, and at least one pull tab 175 (shown as 175*a* and 175*b* in some figures). The at least one sealing surface 174 may be made of the same material as main surface 172, or may be made of a different material than main surface 172. In an embodiment, at least one sealing surface 174 may include a breakaway plastic seal, for example, a plastic membrane material. In another embodiment, the main surface and the at least one sealing surface may both be made of the same material (e.g., aluminum or plastic) and separated by at least one break line 176.

In the illustrated embodiment, the at least one sealing surface 174 is attached to main surface 172 by at least one break line 176, wherein the at least one sealing surface 174 on one side of break line 176 may break away from main surface 172 on the other side of break line 176 when a force is applied to the at least one sealing surface 174 and/or main surface 172. In the illustrated embodiment, the at least one sealing surface 174 is broken from main surface 172 across the at least one break line 176 when a downward force is applied to the at least one sealing surface 174 by pull tab 175. In an alternative embodiment, the at least one sealing surface 174 may be broken from main surface 172 across the at least one break line 176 when an upward and/or sideways force is applied to the at least one sealing surface 174 by pull tab 175.

In the illustrated embodiment the at least one sealing surface 174 includes three break lines 176 and a fold line 178. Fold line 178 is configured to enable the at least one sealing surface 174 to bend and/or rotate with respect to main surface 172 while remaining attached to main surface 172. In the illustrated embodiment, the at least one sealing surface 174 breaks along the three break lines 176 and bends into or away from body 112 along fold line 178 when a force is applied to the at least one sealing surface 174 by pull tab 175. Those of ordinary skill in the art will recognize from this disclosure that more or less break lines 176 and/or fold lines 178 may be used.

In the illustrated embodiment, the at least one sealing surface 174 includes a first sealing surface 174*a* and a second sealing surface 174*b* (shown generally as reference number 174 in some figures). First sealing surface 174*a* is configured to align with first aperture structure 124*a* when beverage container 110 is unsealed, enabling a user to drink the beverage through first aperture structure 124*a*. Second sealing surface 174*b* is configured to align with second aperture structure 124*b* when beverage container 110 is unsealed, enabling air to pass from the outside environment into contact with the beverage within beverage container 110 so that the beverage may flow freely to the user through first aperture structure 124*a*.

In the illustrated embodiment, the at least one pull tab 175 includes a first pull tab 175*a* and a second pull tab 175*b* (shown generally as reference number 175 in some figures). In the illustrated embodiment, first pull tab 175*a* is mounted to first sealing surface 174*a*, and second pull tab 175*b* is mounted to second sealing surface 174*b*. In an alternative embodiment, one or both of first pull tab 175*a* and/or second pull tab 174*b* may be attached to main surface 172. In an embodiment, one or both of first pull tab 175*a* and/or second pull tab 174*b* may be attached to a sealing surface 174 and/or main surface 172 using a rivet. In another embodiment, pull tab 175 may be integrally formed with sealing surface 174. As explained in more detail below, pull tab 175*a* may be caused to open first sealing surface 174*a* by a force applied by first projection 140*a* when lid 114 is rotated, while pull tab 175*b* may be caused to open second sealing surface 174*b* by a force applied by second projection 140*b* when lid 114 is rotated.

Figure 18:
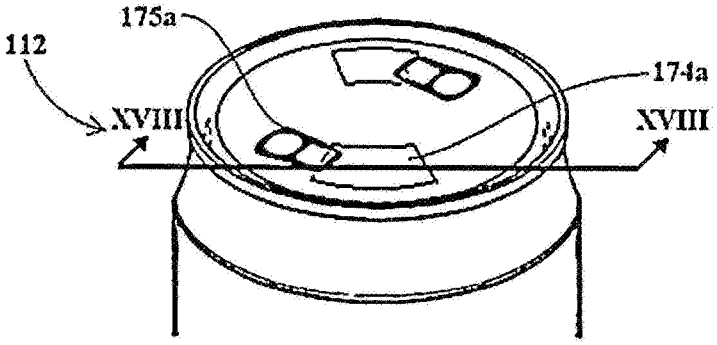
FIG. 18 illustrates a front side cross-sectional view of the body of the beverage container of FIGS. 12A and 12B, taken through lines XVII-XVIII.
Figure 18:
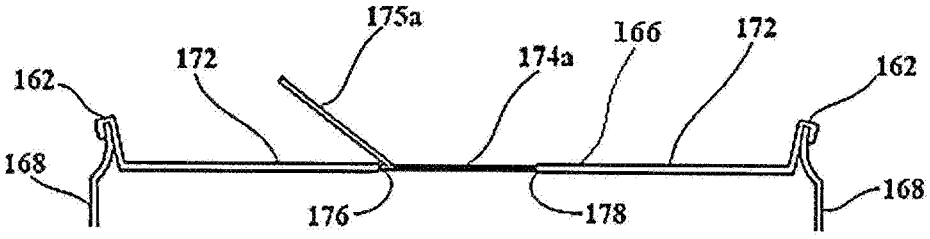
Figure 19:
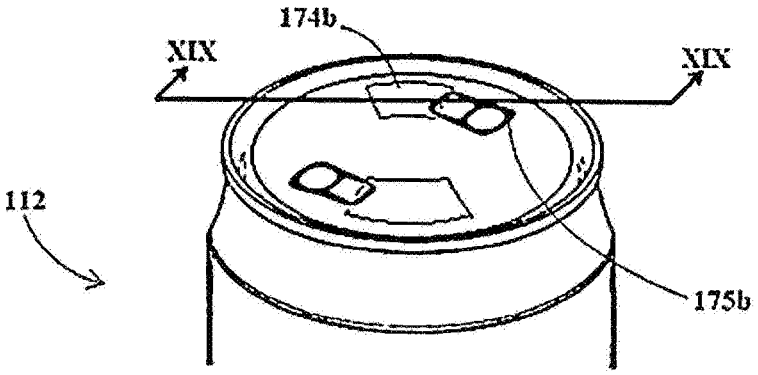
FIG. 19 illustrates a front side cross-sectional view of the body of the beverage container of FIGS. 12A and 12B, taken through lines XIX-XIX.
Figure 19:
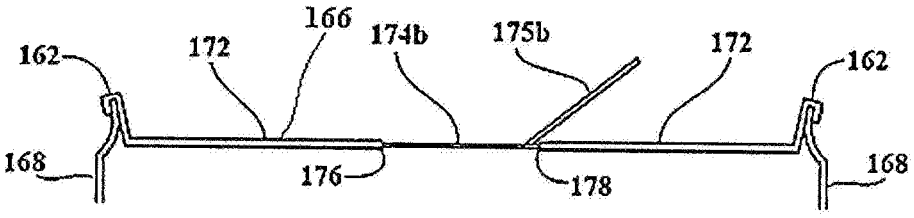

FIGS. 18 and 19 illustrate body 114 in more detail. As illustrated, top surface 166 and the at least one side surface 168 may be formed of separate materials, e.g. aluminum or plastic, wherein outer rim 162 of body 112 is created by forming top surface 166 over the at least one side surface 168 using suitable manufacturing methods known in the art.

FIGS. 20A to 20D illustrate an example embodiment of how lid 114 may be rotated with respect to body 114 to unseal the beverage within beverage container 110. Those of ordinary skill in the art will recognize from this disclosure that modifications may be made to the methods and structures shown without departing from the spirit and scope of the beverage containers discussed herein.

Figure 20A:
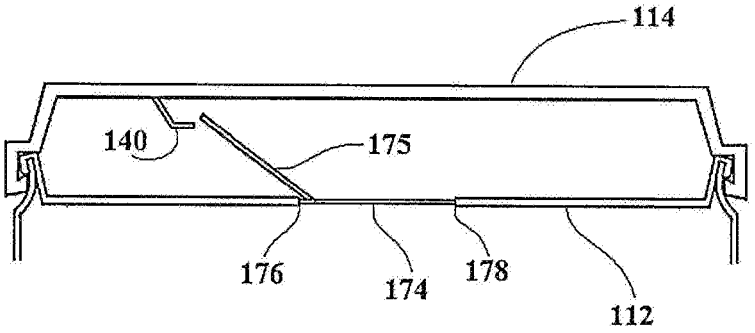
FIGS. 20A to 20D illustrate side cross-sectional views of example steps of unsealing the beverage container of FIGS. 12A and 12B, as the lid is rotated with respect to the body.

FIG. 20A illustrates beverage container 110 once lid 114 has been initially attached to body 112. At this point, beverage container 110 is still sealed. Lid 114 may be attached to body 112, for example by snap-fit as explained above, so as to allow lid 114 to rotate fully or at least partially with respect to body 112. In FIG. 20A, projection 140 is aligned with pull tab 175 but not yet applying a force to pull tab 175.

Figure 20B:
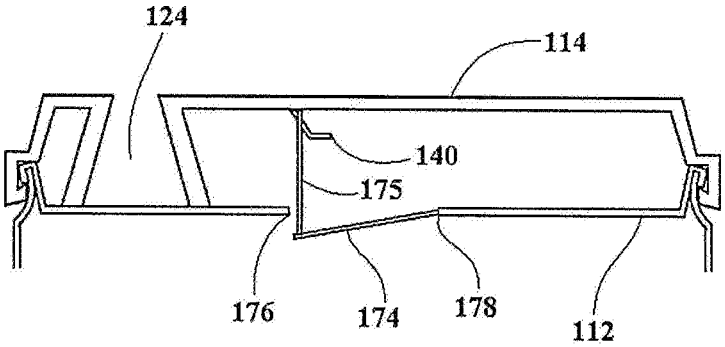

FIG. 20B shows lid 114 slightly rotated with respect to body 112 in comparison with FIG. 20A, such that projection 140 has entered an aperture of pull tab 175 and caused pull tab 175 to break the seal between the beverage within body 112 and the outer environment. FIG. 20B illustrates beverage container 110 just as the seal is broken between the beverage within body 112 and the outer environment. The seal may be broken, for example, by using projection 140 to push pull tab 175 into the sealing surface 174 (e.g., pushing the top of pull tab to the right in FIG. 20B, thus forcing the bottom of pull tab 175 downward). In the illustrated embodiment, the seal is broken when pull tab 175 presses downwardly against the sealing surface 174, causing the sealing surface 174 to be broken from main surface 172 along break line 176. In an alternative embodiment, pull tab 175 may not push downwardly onto the sealing surface 174, and may instead unseal the beverage by pulling upwardly on the sealing surface 174 as illustrated in FIG. 20C (e.g., FIG. 20B may be skipped).

Figure 20C:
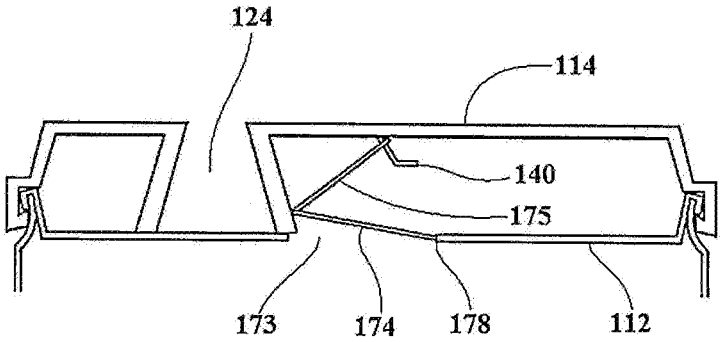

FIG. 20C shows lid 114 slightly rotated with respect to body 112 in comparison with FIG. 20B, such that projection 140 has pulled pull tab 175 to the right, thereby causing pull tab 175 to pull upwardly on the sealing surface 174, thus also pulling the sealing surface 174 to the right.

Figure 20D:
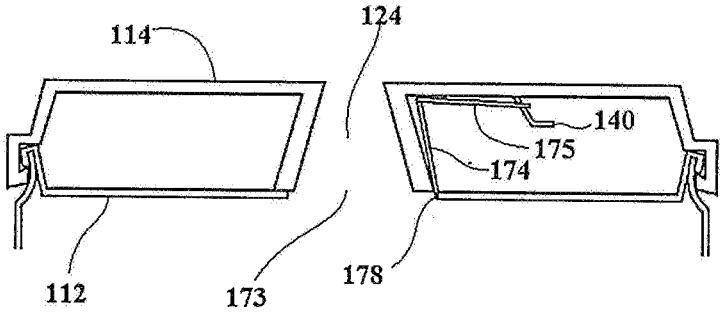

FIG. 20D shows lid 114 slightly rotated with respect to body 112 in comparison with FIG. 20C, such that projection 140 has pulled pull tab 175 and the sealing surface 174 all the way to the right, thereby completely unsealing the beverage within body 112 and aligning aperture structure 124 with a corresponding aperture 173 in main surface 172 where the sealing surface 174 used to be. With the sealing surface 174 pulled all the way to the side, the sealing surface 174 does not disrupt flow of the beverage through aperture 173 and/or aperture structure 124.

It should be understood from this disclosure that FIGS. 20A to 20D illustrate the opening of first sealing surface 174*a* and/or the opening of second sealing surface 174*b*, which may both be opened simultaneously by the rotation of lid 114 with respect to body 112 due to the positioning and configuration of first sealing surface 174*a* and second sealing surface 174*b* on opposite sides of top surface 166 of body 112. Looking from the same side view at first sealing surface 174*a* and second sealing surface 174*b*, first sealing surface 174*a* would open in one direction, and second sealing surface 174*b* would open in the opposite direction, as illustrated for example by FIG. 13B, with both directions being the same rotational direction around the center of lid 114 and/or body 112.

Figure 21A:
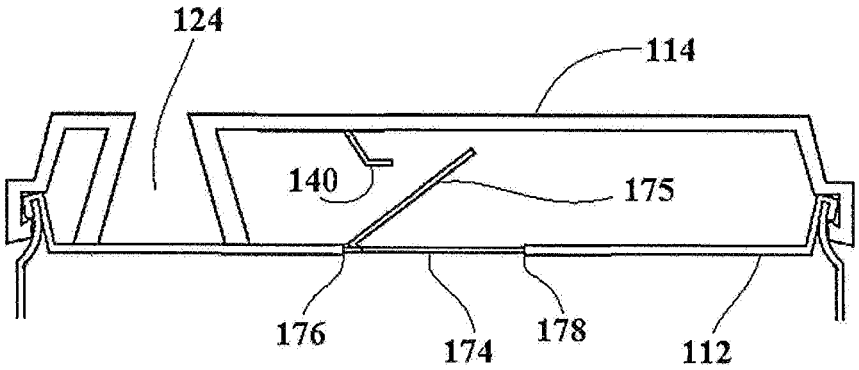
FIGS. 21A to 21C illustrate a side cross-sectional view of example steps of unsealing an alternative example embodiment of a beverage container according to the present disclosure.
Figure 21B:
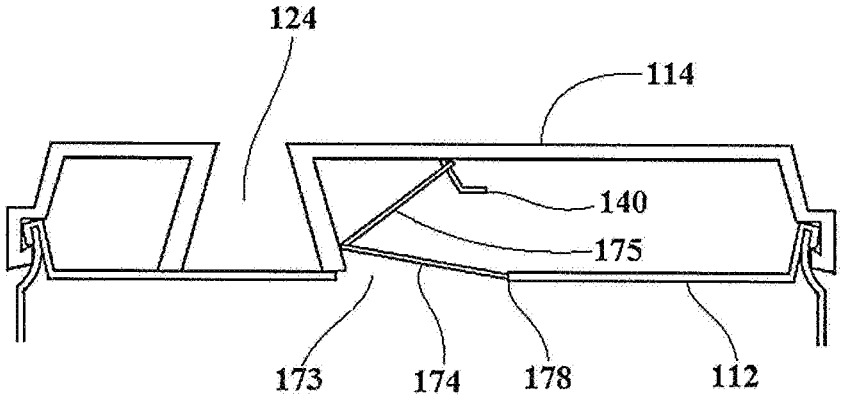
Figure 21C:
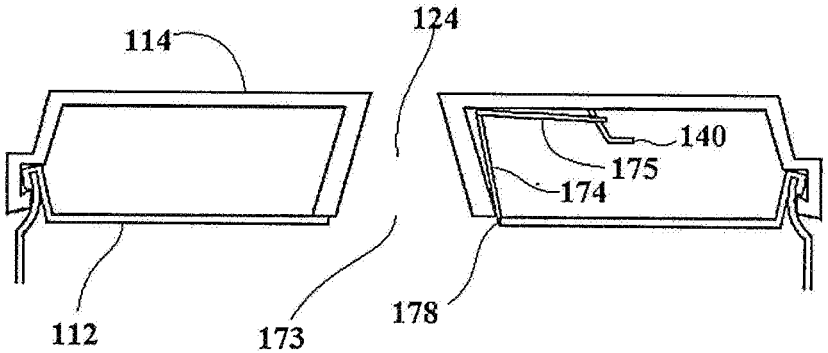

FIGS. 21A to 21C illustrate an alternative embodiment of FIGS. 20A to 20D in which pull tab 175 is oriented in the opposite direction to overlay sealing surface 174 when viewed from above (e.g., when viewed from the perspective of FIG. 17). As illustrated, projection 140 causes pull tab 175 to pull upwardly on sealing surface 174 when projection 140 pulls pull tab 175 to the side as lid 114 is rotated with respect to body 112.

In an embodiment, all or a portion of lid 114 may be made transparent, so that a user may inspect the at least one sealing surface 174 prior to opening the beverage to ensure that the at least one sealing surface 174 has not been compromised and that the beverage within beverage container 110 is safe to drink. In another embodiment, lid 114 may include one or more additional aperture to allow visual inspection of at least one sealing surface 174.

In an embodiment, body 112 and lid 114 may be formed of different materials. For example, body 114 may be formed of a metal such as aluminum which may assist in keeping the beverage therein colder and/or fresher for a longer period of time, while lid 114 may be formed of another material such as plastic so that the user does not have to press his or her lips up against a metal to drink the beverage. This configuration may be advantageous, for example, because certain beverages may taste differently when consumed directly from metal. In an alternative embodiment, body 112 and lid 114 may be formed from the same material.

It should be understood that modifications may be made to the above-described embodiments without departing from the spirit and scope of the present disclosure. FIGS. 22, 23 and 24 illustrate a few such modifications.

Figure 22A:
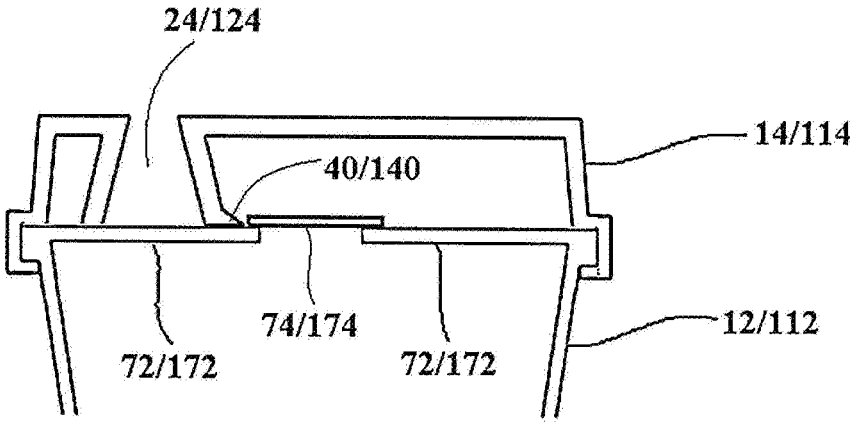
FIGS. 22A to 22C illustrate a side cross-sectional view of example steps of unsealing an alternative example embodiment of a beverage container according to the present disclosure.
Figure 22B:
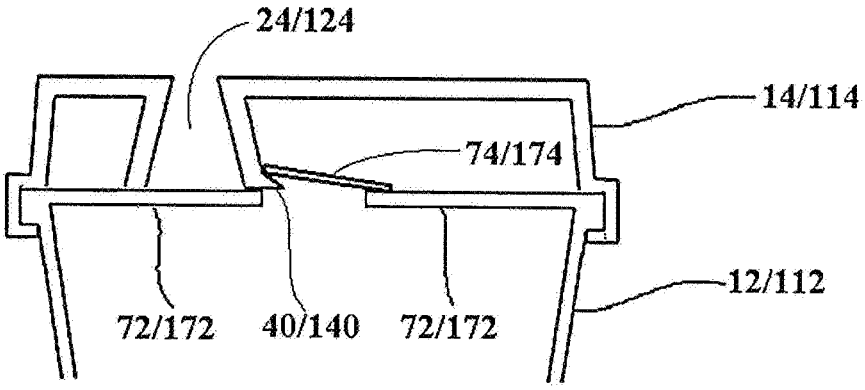
Figure 22C:
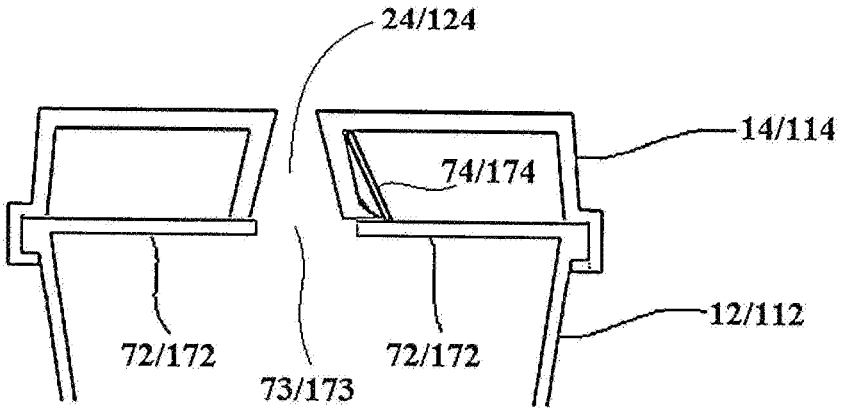

FIGS. 22A to 22C illustrate an example embodiment in which the at least one sealing surface 74/174 is placed on top of and/or partially overlaps the main surface 72/172, and wherein the projection 40/140 includes a wedge shape which protrudes outwardly from the outer wall 34/134 of aperture structure 24/124. As lid 14/114 rotates with respect to body 12/112, projection 40/140 wedges underneath the at least one sealing surface 74/174, lifting and rotating the at least one sealing surface to unseal the beverage and reveal a body aperture 73/173.

Figure 23A:
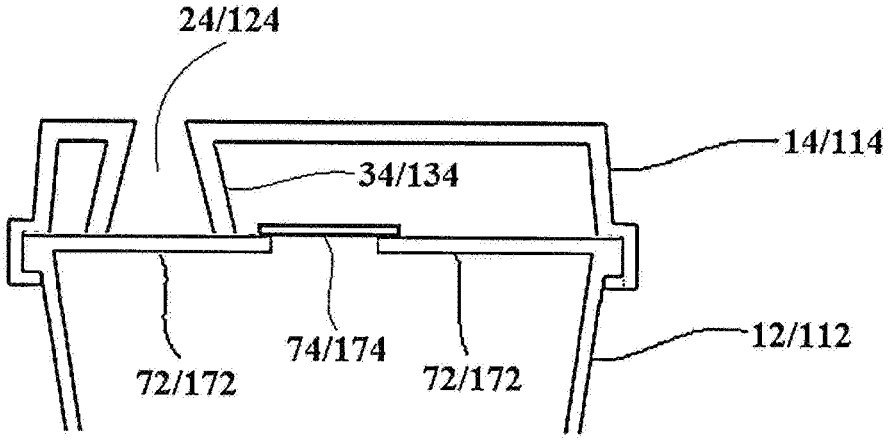
FIGS. 23A to 23C illustrate a side cross-sectional view of example steps of unsealing an alternative example embodiment of a beverage container according to the present disclosure.
Figure 23B:
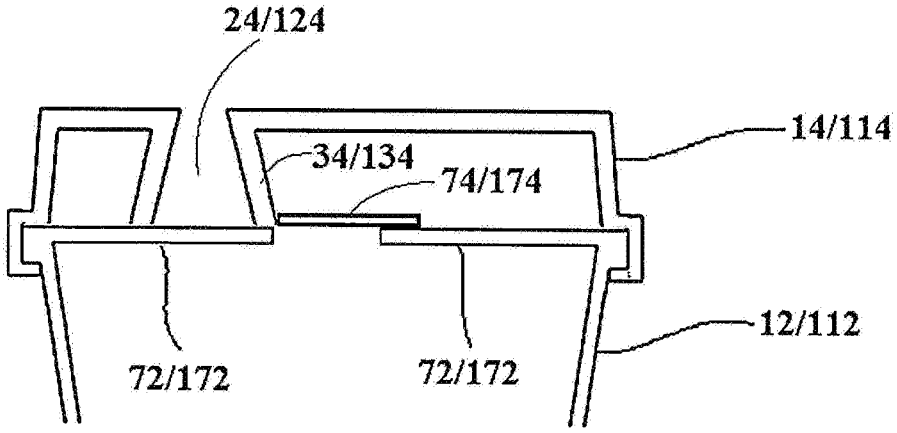
Figure 23C:
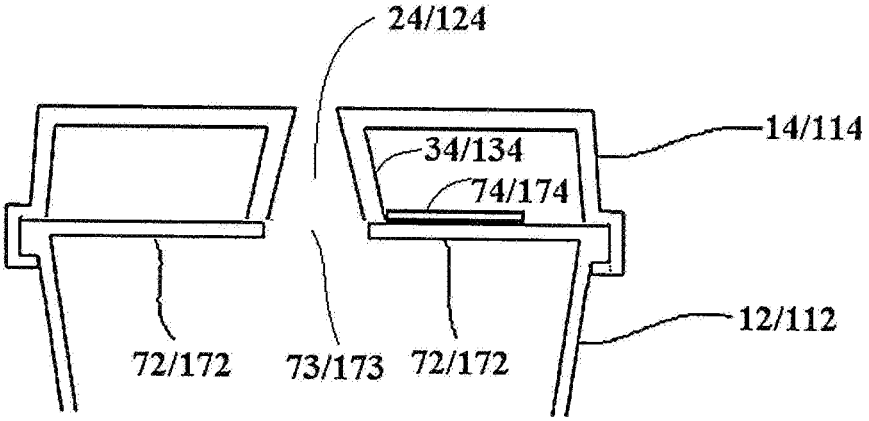
Figure 24:
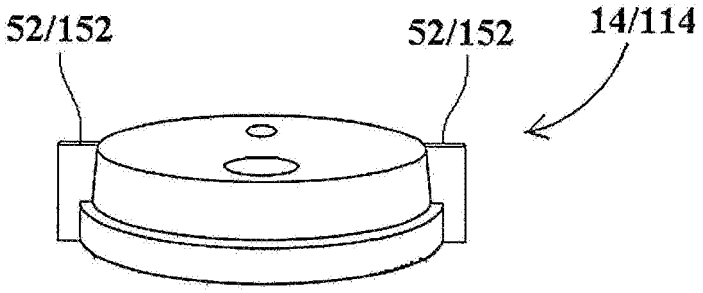
FIG. 24 illustrates a front perspective view of an alternative embodiment of a lid according to the present disclosure.

FIGS. 23A to 23C illustrate an example embodiment in which the at least one sealing surface 74/174 is placed on top of and/or partially overlaps the main surface 72/172 and slides parallel to main surface 72/172 when pushed to the side by the outer wall 34/134 of aperture structure 24/124. As lid 14/114 rotates with respect to body 12/112, outer wall 34/134 displaces the at least one sealing surface 74/174, pushing the at least one sealing surface 74/174 over the main surface to reveal a body aperture 73/173.

In an alternative embodiment, rotation of lid 14/114 with respect to body 12/112 may not unseal at least one sealing surface 74/174. Rotation of lid 14/114 with respect to body 12/112 may simply align one or more aperture or aperture structure 24/124 with one or more sealing surface 74/174, so that the user may manually unseal the sealing surface 74/174, for example, by pulling a pull tab or poking a straw through the one or more sealing surface.

The embodiments disclosed herein further show projection 40/140 protruding from a top surface 20/120 or another element attached thereto. It should further be understood that embodiments may be constructed with the projection 40/140 protruding from aside wall 21/121.

In an embodiment, a lid 14/114 according to the present disclosure may be formed to assist the user with rotation of the lid 14/114 with respect to the body 12/112. FIG. 24 illustrates an example embodiment of a lid 14/114 including one or more gripping protuberances 52/152 that a user may grip to rotate lid 14/114.

In an embodiment, projection 40/140 may break the seal of sealing surface when lid 14/114 is pushed or translated downwardly towards body 12/112 without rotation, for example, by applying a force to sealing surface 74/174 to push sealing surface 74/174 into body 12/112. Rotation of lid 14/114 with respect body 12/112 may occur before or after the downward translation to align certain elements as described above. In an embodiment, rotation may be excluded, and lid 14/114 may only be attached to body 12/112 in a configuration which enables projection 40/140 to break the seal of sealing surface 74/174 when lid 14/114 is pushed or translated downwardly towards body 12/112.

It should be understood from the present disclosure that the embodiments described herein may also be used to seal liquids besides drinkable beverages.

Modifications in addition to those described above may be made to the structures and techniques described herein without departing from the spirit and scope of the disclosure. Accordingly, although specific embodiments have been described, these are examples only and are not limiting on the scope of the disclosure.

Additional Aspects of the Disclosure

Aspects of the subject matter described herein may be useful alone or in combination with any one or more of other aspect described herein. Without limiting the foregoing description, in a first aspect of the present disclosure, a beverage container includes a body configured to seal a beverage therein, the body including at least a top surface, the top surface including a main surface and at least one sealing surface covering a body aperture, and a lid configured to at least partially cover the top surface of the body, the lid including at least one projection which unseals the at least one sealing surface to reveal the body aperture when the lid is rotated with respect to the body.

In accordance with a second aspect of the present disclosure, which may be used in combination with any other aspect or combination of aspects listed herein, the at least one sealing surface includes a first sealing surface covering a first body aperture and a second sealing surface covering a second body aperture, and the at least one projection unseals the first sealing surface to reveal the first body aperture and the second sealing surface to reveal the second body aperture when the lid is rotated with respect to the body.

In accordance with a third aspect of the present disclosure, which may be used in combination with any other aspect or combination of aspects listed herein, the first sealing surface and the second sealing surface are located on opposite sides of the top surface of the body.

In accordance with a fourth aspect of the present disclosure, which may be used in combination with any other aspect or combination of aspects listed herein, the at least one projection unseals the first sealing surface and the second sealing surface simultaneously.

In accordance with a fifth aspect of the present disclosure, which may be used in combination with any other aspect or combination of aspects listed herein, the first sealing surface and the second sealing surface are unsealed along a same rotational direction around a center of the body In accordance with a sixth aspect of the present disclosure, which may be used in combination with any other aspect or combination of aspects listed herein, the at least one projection includes a first projection and a second projection, the first projection configured to unseal the first sealing surface to reveal the first body aperture and the second projection configured to unseal the second sealing surface to reveal the second body aperture.

In accordance with a seventh aspect of the present disclosure, which may be used in combination with any other aspect or combination of aspects listed herein, the first projection and the second projection are located on opposite sides of the lid.

In accordance with an eighth aspect of the present disclosure, which may be used in combination with any other aspect or combination of aspects listed herein, wherein the at least one projection is configured to cause the at least one sealing surface to detach from the main surface along at least one break line.

In accordance with a ninth aspect of the present disclosure, which may be used in combination with any other aspect or combination of aspects listed herein, the at least one projection is configured to cause the at least one sealing surface to rotate with respect to the main surface along a fold line.

In accordance with a tenth aspect of the present disclosure, which may be used in combination with any other aspect or combination of aspects listed herein, the at least one projection is configured to apply a force to a pull tab to cause the at least one sealing surface to reveal the body aperture.

In accordance with an eleventh aspect of the present disclosure, which may be used in combination with any other aspect or combination of aspects listed herein, the at least one projection protrudes downwardly from a top surface of the lid.

In accordance with a twelfth aspect of the present disclosure, which may be used in combination with any other aspect or combination of aspects listed herein, the lid includes at least one aperture structure, and the at least one aperture structure includes at least one lid aperture and at least one sidewall surrounding the at least one lid aperture.

In accordance with a thirteenth aspect of the present disclosure, which may be used in combination with any other aspect or combination of aspects listed herein, the at least one projection protrudes downwardly from the at least one sidewall.

In accordance with a fourteenth aspect of the present disclosure, which may be used in combination with any other aspect or combination of aspects listed herein, the at least one projection protrudes outwardly from the at least one sidewall.

In accordance with a fifteenth aspect of the present disclosure, which may be used in combination with any other aspect or combination of aspects listed herein, the at least one sidewall is angled downwardly and outwardly from the top surface to cause the aperture to increase in size from top to bottom.

In accordance with a sixteenth aspect of the present disclosure, which may be used in combination with any other aspect or combination of aspects listed herein, the at least one sidewall is angled downwardly and inwardly from the top surface to cause the aperture to decrease in size from top to bottom.

In accordance with a seventeenth aspect of the present disclosure, which may be used in combination with any other aspect or combination of aspects listed herein, the at least one aperture is smaller at a top surface of the lid than near the body when the lid is attached to the body.

In accordance with an eighteenth aspect of the present disclosure, which may be used in combination with any other aspect or combination of aspects listed herein, the at least one aperture is larger at a top surface of the lid than near the body when the lid is attached to the body.

In accordance with a nineteenth aspect of the present disclosure, which may be used in combination with any other aspect or combination of aspects listed herein, the body includes at least one outer tab, and the lid includes at least one protrusion configured to protrude into the at least one outer tab to cause at least one of: (i) the lid to be attached to the body; and/or (ii) the at least one projection to unseal the at least one sealing surface to reveal the body aperture when the lid is rotated with respect to the body.

In accordance with a twentieth aspect of the present disclosure, which may be used in combination with any other aspect or combination of aspects listed herein, the at least one outer tab includes a track, wherein movement of the lid with respect to the body causes the at least one protrusion to move along the track.

In accordance with a twenty-first aspect of the present disclosure, which may be used in combination with any other aspect or combination of aspects listed herein, the track includes at least one angled portion configured to cause the lid to be pulled closer to the body as the at least one protrusion moves along the angled portion.

In accordance with a twenty-second aspect of the present disclosure, which may be used in combination with any other aspect or combination of aspects listed herein, the track includes at least one indentation configured to cause the lid to be rotationally stationary with respect to the body unless a user pushes the lid into the body to release the at least one protrusion from the at least one indentation.

In accordance with a twenty-third aspect of the present disclosure, which may be used in combination with any other aspect or combination of aspects listed herein, the track includes a first angled portion, a first indentation, a second angled portion, and a second indentation.

In accordance with a twenty-fourth aspect of the present disclosure, which may be used in combination with any other aspect or combination of aspects listed herein, the lid is attached to the body by translating the at least one projection of the lid along the first angled portion and into the first indentation.

In accordance with a twenty-fifth aspect of the present disclosure, which may be used in combination with any other aspect or combination of aspects listed herein, the at least one sealing portion is caused to be unsealed by translating the at least one projection of the lid along the second angled portion and into the second indentation.

In accordance with a twenty-sixth aspect of the present disclosure, which may be used in combination with any other aspect or combination of aspects listed herein, the body includes at least one outer tab, and wherein the lid includes at least one protrusion configured to protrude into the at least one outer tab, wherein interaction between the outer tab and the at least one protrusion causes the lid to be pulled closer to the body when the lid is rotated with respect to the body.

In accordance with a twenty-seventh aspect of the present disclosure, which may be used in combination with any other aspect or combination of aspects listed herein, the body includes at least one outer tab, and wherein the lid includes at least one protrusion configured to protrude into the at least one outer tab, wherein interaction between the outer tab and the at least one protrusion causes the at least one projection to unseal the at least one sealing surface to reveal the body aperture when the lid is rotated with respect to the body.

In accordance with a twenty-eighth aspect of the present disclosure, which may be used in combination with any other aspect or combination of aspects listed herein, the at least one projection pushes the at least one sealing surface into the main surface to unseal the at least one sealing surface when the lid is rotated with respect to the body.

In accordance with a twenty-ninth aspect of the present disclosure, which may be used in combination with any other aspect or combination of aspects listed herein, the at least one projection pushes the at least one sealing surface into the main surface by applying a force to a pull tab configured to push the at least one sealing surface into the main surface.

In accordance with a thirtieth aspect of the present disclosure, which may be used in combination with any other aspect or combination of aspects listed herein, the at least one projection pulls the at least one sealing surface upwardly from the main surface to unseal the at least one sealing surface when the lid is rotated with respect to the body.

In accordance with a thirty-first aspect of the present disclosure, which may be used in combination with any other aspect or combination of aspects listed herein, the at least one projection pulls the at least one sealing surface upwardly by applying a force to a pull tab configured to pull the at least one sealing surface upwardly from the main surface.

In accordance with a thirty-second aspect of the present disclosure, which may be used in combination with any other aspect or combination of aspects listed herein, the body is formed from aluminum, and the lid is formed from a material other than aluminum.

In accordance with a thirty-third aspect of the present disclosure, which may be used in combination with any other aspect or combination of aspects listed herein, the body and the lid are formed from different materials.

In accordance with a thirty-fourth aspect of the present disclosure, which may be used in combination with any other aspect or combination of aspects listed herein, the body and the lid are formed from a same material.

In accordance with a thirty-fifth aspect of the present disclosure, which may be used in combination with any other aspect or combination of aspects listed herein, the lid is at least partially transparent or includes a viewing aperture to enable a user to view the at least one sealing surface to ensure that the at least one sealing surface is not compromised prior to unsealing.

In accordance with a thirty-sixth aspect of the present disclosure, which may be used in combination with any other aspect or combination of aspects listed herein, a beverage container includes a body configured to seal a beverage therein, the body including a top surface, the top surface including a main surface, a first sealing surface covering a first body aperture, and a second sealing surface covering a second body aperture, and a lid configured to at least partially cover the top surface of the body, the lid including (i) a first projection which unseals the first sealing surface to reveal the first body aperture when the lid is rotated with respect to the body, and (ii) a second projection which unseals the second sealing surface to reveal the second body aperture when the lid is rotated with respect to the body.

In accordance with a thirty-seventh aspect of the present disclosure, which may be used in combination with any other aspect or combination of aspects listed herein, rotation of the lid with respect to the body causes the first sealing surface and the second sealing surface to be unsealed simultaneously In accordance with a thirty-eighth aspect of the present disclosure, the first projection unseals the first sealing surface by applying a force to a pull tab attached to or located adjacent to the first sealing surface.

In accordance with a thirty-ninth aspect of the present disclosure, which may be used in combination with any other aspect or combination of aspects listed herein, the second projection unseals the second sealing surface by applying a force to a pull tab attached to or located adjacent to the second sealing surface In accordance with a fortieth aspect of the present disclosure, which may be used in combination with any other aspect or combination of aspects listed herein, the first sealing surface and the second sealing surface are located on opposite sides of the top surface.

In accordance with a forty-first aspect of the present disclosure, which may be used in combination with any other aspect or combination of aspects listed herein, the first sealing surface and the second sealing surface are opened in the same rotational direction.

In accordance with a forty-second aspect of the present disclosure, which may be used in combination with any other aspect or combination of aspects listed herein, a beverage container includes a body configured to seal a beverage therein, the body including a top surface, the top surface including a main surface and at least one sealing surface covering a body aperture, and a lid configured to at least partially cover the top surface of the body, the lid including at least one projection and at least one lid aperture, wherein rotation of the lid with respect to the body is configured to cause: (i) the at least one projection to unseal the sealing surface to reveal the body aperture; and (ii) the at least one lid aperture to align with the at least one body aperture so that the beverage may be poured from the body through the at least one body aperture and the at least one lid aperture.

In accordance with a forty-third aspect of the present disclosure, which may be used in combination with any other aspect or combination of aspects listed herein, the at least one sealing surface includes a first sealing surface covering a first body aperture and a second sealing surface covering a second body aperture, and the at least one projection unseals the first sealing surface to reveal the first body aperture and the second sealing surface to reveal the second body aperture when the lid is rotated with respect to the body In accordance with a forty-fourth aspect of the present disclosure, which may be used in combination with any other aspect or combination of aspects listed herein, the first sealing surface and the second sealing surface are located on opposite sides of the top surface of the body.

In accordance with a forty-fifth aspect of the present disclosure, which may be used in combination with any other aspect or combination of aspects listed herein, the at least one projection unseals the first sealing surface and the second sealing surface simultaneously.

In accordance with a forty-sixth aspect of the present disclosure, which may be used in combination with any other aspect or combination of aspects listed herein, the first sealing surface and the second sealing surface are unsealed along a same rotational direction around a center of the body.

In accordance with a forty-seventh aspect of the present disclosure, which may be used in combination with any other aspect or combination of aspects listed herein, the at least one projection includes a first projection and a second projection, the first projection configured to unseal the first sealing surface to reveal the first body aperture and the second projection configured to unseal the second sealing surface to reveal the second body aperture.

In accordance with a forty-eighth aspect of the present disclosure, which may be used in combination with any other aspect or combination of aspects listed herein, the first projection and the second projection are located on opposite sides of the lid.

In accordance with a forty-ninth aspect of the present disclosure, which may be used in combination with any other aspect or combination of aspects listed herein, the at least one projection is configured to cause the at least one sealing surface to detach from the main surface along at least one break line.

In accordance with a fiftieth aspect of the present disclosure, which may be used in combination with any other aspect or combination of aspects listed herein, the at least one projection is configured to cause the at least one sealing surface to rotate with respect to the main surface along a fold line.

In accordance with a fifty-first aspect of the present disclosure, which may be used in combination with any other aspect or combination of aspects listed herein, the at least one projection is configured to apply a force to a pull tab to cause the at least one sealing surface to reveal the body aperture.

In accordance with a fifty-second aspect of the present disclosure, which may be used in combination with any other aspect or combination of aspects listed herein, the at least one projection protrudes downwardly from a top surface of the lid.

In accordance with a fifty-third aspect of the present disclosure, which may be used in combination with any other aspect or combination of aspects listed herein, the lid includes at least one aperture structure, and wherein the at least one aperture structure includes at least one lid aperture and at least one sidewall surrounding the at least one lid aperture.

In accordance with a fifty-fourth aspect of the present disclosure, which may be used in combination with any other aspect or combination of aspects listed herein, the at least one projection protrudes downwardly from the at least one sidewall.

In accordance with a fifty-fifth aspect of the present disclosure, which may be used in combination with any other aspect or combination of aspects listed herein, the at least one projection protrudes outwardly from the at least one sidewall.

In accordance with a fifty-sixth aspect of the present disclosure, which may be used in combination with any other aspect or combination of aspects listed herein, the at least one sidewall is angled downwardly and outwardly from the top surface to cause the aperture to increase in size from top to bottom.

In accordance with a fifty-seventh aspect of the present disclosure, which may be used in combination with any other aspect or combination of aspects listed herein, the at least one sidewall is angled downwardly and inwardly from the top surface to cause the aperture to decrease in size from top to bottom.

In accordance with a fifty-eighth aspect of the present disclosure, which may be used in combination with any other aspect or combination of aspects listed herein, the at least one aperture is smaller at a top surface of the lid than near the body when the lid is attached to the body.

In accordance with a fifty-ninth aspect of the present disclosure, which may be used in combination with any other aspect or combination of aspects listed herein, the at least one aperture is larger at a top surface of the lid than near the body when the lid is attached to the body.

In accordance with a sixtieth aspect of the present disclosure, which may be used in combination with any other aspect or combination of aspects listed herein, the body includes at least one outer tab, and the lid includes at least one protrusion configured to protrude into the at least one outer tab to cause at least one of: (i) the lid to be attached to the body; and/or (ii) the at least one projection to unseal the at least one sealing surface to reveal the body aperture when the lid is rotated with respect to the body In accordance with a sixty-first aspect of the present disclosure, which may be used in combination with any other aspect or combination of aspects listed herein, the at least one outer tab includes a track, wherein movement of the lid with respect to the body causes the at least one protrusion to move along the track.

In accordance with a sixty-second aspect of the present disclosure, which may be used in combination with any other aspect or combination of aspects listed herein, the track includes at least one angled portion configured to cause the lid to be pulled closer to the body as the at least one protrusion moves along the angled portion.

In accordance with a sixty-third aspect of the present disclosure, which may be used in combination with any other aspect or combination of aspects listed herein, the track includes at least one indentation configured to cause the lid to be rotationally stationary with respect to the body unless a user pushes the lid into the body to release the at least one protrusion from the at least one indentation.

In accordance with a sixty-fourth aspect of the present disclosure, which may be used in combination with any other aspect or combination of aspects listed herein, the track includes a first angled portion, a first indentation, a second angled portion, and a second indentation.

In accordance with a sixty-fifth aspect of the present disclosure, which may be used in combination with any other aspect or combination of aspects listed herein, the lid is attached to the body by translating the at least one projection of the lid along the first angled portion and into the first indentation.

In accordance with a sixty-sixth aspect of the present disclosure, which may be used in combination with any other aspect or combination of aspects listed herein, the at least one sealing portion is caused to be unsealed by translating the at least one projection of the lid along the second angled portion and into the second indentation.

In accordance with a sixty-seventh aspect of the present disclosure, which may be used in combination with any other aspect or combination of aspects listed herein, the body includes at least one outer tab, and wherein the lid includes at least one protrusion configured to protrude into the at least one outer tab, wherein interaction between the outer tab and the at least one protrusion causes the lid to be pulled closer to the body when the lid is rotated with respect to the body.

In accordance with a sixty-eighth aspect of the present disclosure, which may be used in combination with any other aspect or combination of aspects listed herein, the body includes at least one outer tab, and wherein the lid includes at least one protrusion configured to protrude into the at least one outer tab, wherein interaction between the outer tab and the at least one protrusion causes the at least one projection to unseal the at least one sealing surface to reveal the body aperture when the lid is rotated with respect to the body.

In accordance with a sixty-ninth aspect of the present disclosure, which may be used in combination with any other aspect or combination of aspects listed herein, the at least one projection pushes the at least one sealing surface into the main surface to unseal the at least one sealing surface when the lid is rotated with respect to the body.

In accordance with a seventieth aspect of the present disclosure, which may be used in combination with any other aspect or combination of aspects listed herein, the at least one projection pushes the at least one sealing surface into the main surface by applying a force to a pull tab configured to push the at least one sealing surface into the main surface.

In accordance with a seventy-first aspect of the present disclosure, which may be used in combination with any other aspect or combination of aspects listed herein, the at least one projection pulls the at least one sealing surface upwardly from the main surface to unseal the at least one sealing surface when the lid is rotated with respect to the body.

In accordance with a seventy-second aspect of the present disclosure, which may be used in combination with any other aspect or combination of aspects listed herein, the at least one projection pulls the at least one sealing surface upwardly by applying a force to a pull tab configured to pull the at least one sealing surface upwardly from the main surface.

In accordance with a seventy-third aspect of the present disclosure, which may be used in combination with any other aspect or combination of aspects listed herein, the body is formed from aluminum, and the lid is formed from a material other than aluminum.

In accordance with a seventy-fourth aspect of the present disclosure, which may be used in combination with any other aspect or combination of aspects listed herein, the body and the lid are formed from different materials.

In accordance with a seventy-fifth aspect of the present disclosure, which may be used in combination with any other aspect or combination of aspects listed herein, the body and the lid are formed from a same material.

In accordance with a seventy-sixth aspect of the present disclosure, which may be used in combination with any other aspect or combination of aspects listed herein, the lid is at least partially transparent or includes a viewing aperture to enable a user to view the at least one sealing surface to ensure that the at least one sealing surface is not compromised prior to unsealing.

In accordance with a seventy-seventh aspect of the present disclosure, which may be used in combination with any other aspect or combination of aspects listed herein, a beverage container includes a body configured to seal a beverage therein, the body including a top surface, the top surface including a main surface, a first sealing surface covering a first body aperture, and a second sealing surface covering a second body aperture, and a lid configured to at least partially cover the top surface of the body, the lid including: (i) a first lid aperture configured to align with the first body aperture when the lid is rotated with respect to the body to unseal the first sealing surface from the first body aperture; and (ii) a second lid aperture configured to align with the second body aperture when the lid is rotated with respect to the body to unseal the second sealing surface from the second body aperture.

In accordance with a seventy-eighth aspect of the present disclosure, which may be used in combination with any other aspect or combination of aspects listed herein, rotation of the lid with respect to the body causes the first sealing surface and the second sealing surface to be unsealed simultaneously.

In accordance with a seventy-ninth aspect of the present disclosure, which may be used in combination with any other aspect or combination of aspects listed herein, the lid includes a first projection and a second projection, wherein the first projection is configured to unseal the first sealing surface from the first body aperture when the lid is rotated with respect to the body, and wherein the second projection is configured to unseal the second sealing surface from the second body aperture when the lid is rotated with respect to the body.

In accordance with an eightieth aspect of the present disclosure, which may be used in combination with any other aspect or combination of aspects listed herein, the first projection unseals the first sealing surface by applying a force to a pull tab attached to or located adjacent to the first sealing surface.

In accordance with an eighty-first aspect of the present disclosure, which may be used in combination with any other aspect or combination of aspects listed herein, the second projection unseals the second sealing surface by applying a force to a pull tab attached to or located adjacent to the second sealing surface.

In accordance with an eighty-second aspect of the present disclosure, which may be used in combination with any other aspect or combination of aspects listed herein, the first sealing surface and the second sealing surface are located on opposite sides of the top surface.

In accordance with an eighty-third aspect of the present disclosure, which may be used in combination with any other aspect or combination of aspects listed herein, the first sealing surface and the second sealing surface are opened in the same rotational direction.

In accordance with an eighty-fourth aspect of the present disclosure, which may be used in combination with any other aspect or combination of aspects listed herein, a beverage container includes a body configured to seal a beverage therein, the body including a top surface, at least one side surface, and a bottom surface, the top surface including a main surface and at least one sealing surface covering a body aperture, wherein the at least one sealing surface may be unsealed to reveal the body aperture by applying a force to the at least one sealing surface, the force applied in a rotational direction around a center point of the top surface of the body.

In accordance with an eighty-fifth aspect of the present disclosure, which may be used in combination with any other aspect or combination of aspects listed herein, the beverage container includes a lid configured to at least partially cover the top surface of the body, the lid applying the force to unseal the at least one sealing surface.

In accordance with an eighty-sixth aspect of the present disclosure, which may be used in combination with any other aspect or combination of aspects listed herein, the at least one sealing surface includes a first sealing surface covering a first body aperture and a second sealing surface covering a second body aperture.

In accordance with an eighty-seventh aspect of the present disclosure, which may be used in combination with any other aspect or combination of aspects listed herein, the first sealing surface and the second sealing surface are located on opposite sides of the top surface of the body.

In accordance with an eighty-eighth aspect of the present disclosure, which may be used in combination with any other aspect or combination of aspects listed herein, the first sealing surface and the second sealing surface are unsealed along a same rotational direction around a center of the body.

In accordance with an eighty-ninth aspect of the present disclosure, which may be used in combination with any other aspect or combination of aspects listed herein, the beverage container includes a pull tab configured to apply the force to the at least one sealing surface in the rotational direction around the center point of the top surface of the body.

In accordance with a ninetieth aspect of the present disclosure, which may be used in combination with any other aspect or combination of aspects listed herein, the pull tab is attached to the at least one sealing surface.

In accordance with a ninety-first aspect of the present disclosure, which may be used in combination with any other aspect or combination of aspects listed herein, the pull tab is attached to the main surface.

In accordance with a ninety-second aspect of the present disclosure, which may be used in combination with any other aspect or combination of aspects listed herein, the body is formed from aluminum.

In accordance with a ninety-third aspect of the present disclosure, which may be used in combination with any other aspect or combination of aspects listed herein, a lid for a beverage container includes a top surface including at least one aperture, a protrusion configured to attach the top surface to a body containing a sealed beverage, and a projection configured to unseal the beverage as the top surface is rotated with respect to the body while the protrusion attaches the lid to the body, such that a user may thereafter pour the beverage through the at least one aperture of the top surface.

In accordance with a ninety-fourth aspect of the present disclosure, which may be used in combination with any other aspect or combination of aspects listed herein, the projection protrudes downwardly from the top surface.

In accordance with a ninety-fifth aspect of the present disclosure, which may be used in combination with any other aspect or combination of aspects listed herein, the lid includes at least one sidewall extending downwardly from the top surface, wherein the protrusion protrudes inwardly from the at least one side wall In accordance with a ninety-sixth aspect of the present disclosure, which may be used in combination with any other aspect or combination of aspects listed herein, the lid includes at least one sidewall extending downwardly from the top surface, wherein the projection protrudes inwardly from the at least one side wall.

In accordance with a ninety-seventh aspect of the present disclosure, which may be used in combination with any other aspect or combination of aspects listed herein, the lid includes a first projection and a second projection, the first projection configured to unseal a first sealing surface on the body and the second projection configured to unseal a second sealing surface on the body.

In accordance with a ninety-eighth aspect of the present disclosure, which may be used in combination with any other aspect or combination of aspects listed herein, wherein the first projection and the second projection are located on opposite sides of the top surface.

In accordance with a ninety-ninth aspect of the present disclosure, which may be used in combination with any other aspect or combination of aspects listed herein, the projection is configured to apply a force to a pull tab to unseal the beverage.

In accordance with a one-hundredth aspect of the present disclosure, which may be used in combination with any other aspect or combination of aspects listed herein, the lid includes at least one aperture structure, and wherein the at least one aperture structure includes the aperture and at least one sidewall surrounding the aperture.

In accordance with a one-hundred-first aspect of the present disclosure, which may be used in combination with any other aspect or combination of aspects listed herein, the projection protrudes downwardly from the at least one sidewall.

In accordance with a one-hundred-second aspect of the present disclosure, which may be used in combination with any other aspect or combination of aspects listed herein, the projection protrudes outwardly from the at least one sidewall.

In accordance with a one-hundred-third aspect of the present disclosure, which may be used in combination with any other aspect or combination of aspects listed herein, the at least one sidewall is angled downwardly and outwardly from the top surface to cause the aperture to increase in size from top to bottom.

In accordance with a one-hundred-fourth aspect of the present disclosure, which may be used in combination with any other aspect or combination of aspects listed herein, the at least one sidewall is angled downwardly and inwardly from the top surface to cause the aperture to decrease in size from top to bottom.

In accordance with a one-hundred-fifth aspect of the present disclosure, which may be used in combination with any other aspect or combination of aspects listed herein, the aperture is smaller at the top surface at the bottom of the at least one sidewall.

In accordance with a one-hundred-sixth aspect of the present disclosure, which may be used in combination with any other aspect or combination of aspects listed herein, wherein the aperture is smaller at the top surface at the bottom of the at least one sidewall.

In accordance with a one-hundred-seventh aspect of the present disclosure, which may be used in combination with any other aspect or combination of aspects listed herein, the protrusion attaches the top surface to the body when a user pushes the top surface into the body.

In accordance with a one-hundred-eighth aspect of the present disclosure, which may be used in combination with any other aspect or combination of aspects listed herein, the protrusion attaches the top surface to the body when a user rotates the top surface with respect to the body.

In accordance with a one-hundred-ninth aspect of the present disclosure, which may be used in combination with any other aspect or combination of aspects listed herein, the protrusion attaches the top surface to the body when a user pushes the top surface into the body and rotates the top surface with respect to the body.

In accordance with a one-hundredth-tenth aspect of the present disclosure, which may be used in combination with any other aspect or combination of aspects listed herein, the protrusion causes the top surface to move closer to the body as the lid is rotated with respect to the body.

In accordance with a one-hundred-eleventh aspect of the present disclosure, which may be used in combination with any other aspect or combination of aspects listed herein, the projection is caused to unseal the beverage as the top surface moves closer to the body during rotation.

In accordance with a one-hundred-twelfth aspect of the present disclosure, which may be used in combination with any other aspect or combination of aspects listed herein, the lid is at least partially transparent or includes a viewing aperture to enable a user to view the body with the lid attached to ensure that the body is not compromised prior to unsealing.

In accordance with a one-hundred-thirteenth aspect of the present disclosure, which may be used in combination with any other aspect or combination of aspects listed herein, a method of sealing a beverage container for a user to thereafter unseal to consume a beverage provided therein includes sealing a beverage into a body having a top surface including at least one sealing surface, attaching a lid including a projection to the top surface of the body, and enabling the lid to be rotated with respect to the body to cause the projection to unseal the at least one sealing surface so that the beverage may be dispensed through the lid.

In accordance with a one-hundred-fourteenth aspect of the present disclosure, which may be used in combination with any other aspect or combination of aspects listed herein, the method includes creating a break line between the at least one sealing surface and a main surface, and enabling the lid to be rotated with respect to the body to cause the at least one sealing surface to be separated from the main surface along the break line.

In accordance with a one-hundred-fifteenth aspect of the present disclosure, which may be used in combination with any other aspect or combination of aspects listed herein, the method enabling the at least one sealing surface to be unsealed in a rotational direction around a central point of the top surface of the body.

In accordance with a one-hundred-sixteenth aspect of the present disclosure, which may be used in combination with any other aspect or combination of aspects listed herein, the method includes configuring the lid to snap fit over the body.

In accordance with a one-hundred-seventeenth aspect of the present disclosure, which may be used in combination with any other aspect or combination of aspects listed herein, the method includes enabling rotation of the lid with respect to the body to cause the lid to be pulled closer to the body In accordance with a one-hundred-eighteenth aspect of the present disclosure, which may be used in combination with any other aspect or combination of aspects listed herein, the method includes enabling the lid to be rotated with respect to the body to cause the projection to apply a force to a pull tab to unseal the at least one sealing surface so that the beverage may be dispensed through the lid.

In accordance with a one-hundred-nineteenth aspect of the present disclosure, which may be used in combination with any other aspect or combination of aspects listed herein, the method includes configuring the lid to attach to a standard aluminum can.

In accordance with a one-hundredth-twentieth aspect of the present disclosure, which may be used in combination with any other aspect or combination of aspects listed herein, a method of unsealing a beverage container includes rotating a lid with respect to a body containing a sealed beverage so that a projection of the lid unseals at least one sealing surface of the body so that the beverage may be dispensed through the lid.

In accordance with a one-hundredth-twenty-first aspect of the present disclosure, which may be used in combination with any other aspect or combination of aspects listed herein, wherein rotation of the lid with respect to a body causes the lid to be pulled closer to the body.

In accordance with a one-hundredth-twenty-second aspect of the present disclosure, which may be used in combination with any other aspect or combination of aspects listed herein, a liquid container includes a body configured to seal a liquid therein, the body including at least a top surface, the top surface including a main surface and at least one sealing surface covering a body aperture, and a lid configured to at least partially cover the top surface of the body, the lid including at least one projection which unseals the at least one sealing surface to reveal the body aperture when the lid is rotated with respect to the body.

In accordance with a one-hundredth-twenty-third aspect of the present disclosure, which may be used in combination with any other aspect or combination of aspects listed herein, a liquid container includes a body configured to seal a liquid therein, the body including a top surface, the top surface including a main surface and at least one sealing surface covering a body aperture, and a lid configured to at least partially cover the top surface of the body, the lid including at least one projection and at least one lid aperture, wherein rotation of the lid with respect to the body is configured to cause: (i) the at least one projection to unseal the sealing surface to reveal the body aperture; and (ii) the at least one lid aperture to align with the at least one body aperture so that the liquid may be poured from the body through the at least one body aperture and the at least one lid aperture.

In accordance with a one-hundredth-twenty-fourth aspect of the present disclosure, which may be used in combination with any other aspect or combination of aspects listed herein, a lid for a beverage container includes a top surface including at least one aperture, a protrusion configured to attach the top surface to a body containing a sealed beverage, and a projection configured to unseal the beverage as the top surface is translated towards the body while the protrusion attaches the lid to the body, such that a user may thereafter pour the beverage through the at least one aperture of the top surface.

In accordance with a one-hundredth-twenty-fifth aspect of the present disclosure, which may be used in combination with any other aspect or combination of aspects listed herein, a method of sealing a beverage container for a user to thereafter unseal to consume a beverage provided therein includes sealing a beverage into a body having a top surface including at least one sealing surface, attaching a lid including a projection to the top surface of the body, and enabling the lid to be translated towards the body to cause the projection to unseal the at least one sealing surface so that the beverage may be dispensed through the lid.

In accordance with a one-hundredth-twenty-sixth aspect of the present disclosure, which may be used in combination with any other aspect or combination of aspects listed herein, a beverage container includes a body configured to seal a beverage therein, the body including at least a top surface, the top surface including a main surface and at least one sealing surface covering a body aperture, and a lid configured to at least partially cover the top surface of the body, the lid including at least one projection which unseals the at least one sealing surface to reveal the body aperture when the lid is translated towards the body.

The invention claimed is:

1. A beverage container comprising:

a body configured to seal a beverage therein, the body having a rotational axis and including at least a top surface, the top surface including a main surface and at least one sealing surface covering at least one body aperture; and a lid configured to at least partially cover the top surface of the body and rotate with respect to the body around the rotational axis, the lid including at least one projection which unseals the at least one sealing surface to reveal the at least one body aperture when the lid is rotated with respect to the body, the rotation of the lid with respect to the body further causing the lid to translate axially towards the body due to interaction between at least one protrusion and at least one tab, the at least one tab including an angled track that contacts the at least one protrusion to cause the lid to translate axially during rotation, and at least one indentation that prevents rotation of the lid with respect to the body unless a user pushes the lid towards the body.

2. The beverage container of claim 1, wherein the at least one sealing surface includes a first sealing surface covering a first body aperture and a second sealing surface covering a second body aperture, the at least one projection includes a first projection and a second projection, the first projection unseals the first sealing surface to reveal the first body aperture when the lid is rotated with respect to the body, and the second projection unseals the second sealing surface to reveal the second body aperture when the lid is rotated with respect to the body.

3. The beverage container of claim 1, wherein the at least one tab includes a first indentation and a second indentation, the first indentation preventing the rotation of the lid with respect to the body when the at least one body aperture is sealed, the second indentation preventing rotation of the lid with respect to the body when the at least one body aperture is unsealed.

4. The beverage container of claim 3, wherein the angled track is located between the first indentation and the second indentation.

5. The beverage container of claim 1, wherein the at least one projection is configured to apply a force to a pull tab to cause the at least one sealing surface to reveal the at least one body aperture.

6. The beverage container of claim 1, wherein the lid includes at least one aperture structure configured to align with the at least one body aperture after the at least one body aperture is unsealed, and wherein the at least one aperture structure includes at least one lid aperture and at least one sidewall surrounding the at least one lid aperture.

7. The beverage container of claim 6, wherein the at least one projection extends from the at least one sidewall.

8. The beverage container of claim 1, wherein the body includes the at least one tab, and the lid includes the at least one protrusion.

9. The beverage container of claim 1, wherein the at least one projection pushes the at least one sealing surface into the main surface to unseal the at least one sealing surface when the lid is rotated with respect to the body.

10. The beverage container of claim 1, wherein the lid is at least partially transparent or includes a viewing aperture to enable a user to view the at least one sealing surface to ensure that the at least one sealing surface is not compromised prior to unsealing.

11. A beverage container comprising:

a body configured to seal a beverage therein, the body having a rotational axis and including a top surface including a main surface and at least one sealing surface covering at least one body aperture, and at least one tab extending at least partially axially with respect to the rotational axis; and a lid configured to at least partially cover the top surface of the body, the lid including at least one projection and at least one lid aperture, wherein rotation of the lid with respect to the body is configured to cause: (i) the at least one projection to apply a force to the at least one tab so that the at least one tab causes the at least one sealing surface to break from the main surface and reveal the at least one body aperture; and (ii) the at least one lid aperture to align with the at least one body aperture so that the beverage may be poured from the body through the at least one body aperture and the at least one lid aperture.

12. The beverage container of claim 11, wherein the at least one projection protrudes downwardly from a top surface of the lid.

13. The beverage container of claim 11, wherein the at least one projection causes the at least one tab to pull the at least one sealing surface upwardly from the main surface to unseal the at least one sealing surface when the lid is rotated with respect to the body.

14. The beverage container of claim 11, wherein the at least one sealing surface includes a first sealing surface covering a first body aperture and a second sealing surface covering a second body aperture, the at least one projection includes a first projection and a second projection, the first projection unseals the first sealing surface to reveal the first body aperture when the lid is rotated with respect to the body, and the second projection unseals the second sealing surface to reveal the second body aperture when the lid is rotated with respect to the body.

15. The beverage container of claim 11, wherein the at least one projection protrudes from a side surface of the lid.

16. The beverage container of claim 11, wherein the lid includes at least one aperture structure configured to align with the at least one body aperture after the at least one body aperture is unsealed, the at least one aperture structure including the at least one lid aperture and at least one outer sidewall protruding from a top surface of the lid towards the body.

17. The beverage container of claim 11, wherein the at least one projection is configured to apply a force to the at least one tab to cause the at least one tab to push the at least one sealing surface into the at least one body aperture.

18. A beverage container comprising:

a body configured to seal a beverage therein, the body having a rotational axis and including at least a top surface, the top surface including a main surface and at least one sealing surface covering at least one body aperture, the main surface and the at least one sealing surface located in a same plane that extends radially with respect to the rotational axis; and a lid configured to at least partially cover the top surface of the body, the lid including at least one projection which unseals the at least one sealing surface to reveal the at least one body aperture when the lid is rotated with respect to the rotational axis without translating axially with respect to the rotational axis.

19. The beverage container of claim 18, wherein the body includes at least one tab extending at least partially axially with respect to the rotational axis, the at least one projection protrudes downwardly from a top surface of the lid towards the body, and the at least one projection applies a force to the at least one tab so that the at least one tab unseals the at least one sealing surface to reveal the at least one body aperture.

20. The beverage container of claim 18, wherein the lid is formed of a plastic, and the body is formed of a metal.

* * * * *